US008776756B2

(12) United States Patent
Cotton

(10) Patent No.: US 8,776,756 B2
(45) Date of Patent: Jul. 15, 2014

(54) SLIDING VALVE ASPIRATION

(71) Applicant: Grace Capital Partners, LLC, Little Rock, AR (US)

(72) Inventor: Gary W Cotton, Ward, AR (US)

(73) Assignee: Grace Capital Partners, LLC, Little Rock, AR (US)

( * ) Notice: Subject to any disclaimer, the term of this patent is extended or adjusted under 35 U.S.C. 154(b) by 0 days.

(21) Appl. No.: 13/863,710

(22) Filed: Apr. 16, 2013

(65) Prior Publication Data

US 2014/0137829 A1 May 22, 2014

Related U.S. Application Data

(60) Continuation-in-part of application No. 13/443,077, filed on Apr. 10, 2012, now Pat. No. 8,459,227, which is a division of application No. 12/387,184, filed on Apr. 29, 2009, now Pat. No. 8,210,147.

(60) Provisional application No. 61/135,267, filed on Jul. 18, 2008.

(51) Int. Cl.
*F01L 5/00* (2006.01)

(52) U.S. Cl.
CPC ..... *F01L 5/00* (2013.01)
USPC ..... 123/188.5; 123/190.8; 123/81 C

(58) Field of Classification Search
CPC ..... F01L 5/00; F01L 5/04; F01L 7/00; F01L 7/02; F01L 3/08
USPC ..... 123/188.4, 188.5, 188.12, 190.8, 123/190.12, 81 R, 81 B, 81 C, 81 D, 84
See application file for complete search history.

(56) References Cited

U.S. PATENT DOCUMENTS

| | | | |
|---|---|---|---|
| 1,069,794 | A | 8/1913 | Lazier |
| 1,114,521 | A | 10/1914 | Platt |
| 1,142,949 | A | 6/1915 | Fay |
| 1,169,353 | A | 1/1916 | Reeve |
| 1,169,354 | A | 1/1916 | Reeve |
| 1,286,967 | A | 12/1918 | Eschwel |
| 1,550,643 | A | 8/1925 | Bullington |
| 1,640,958 | A | 8/1927 | Nelson |
| 1,777,792 | A | 10/1930 | Grace |
| 1,794,256 | A | 2/1931 | Stuart |
| 1,855,634 | A | 4/1932 | Ingalls |
| 1,856,348 | A | 5/1932 | McMillan |
| 1,890,976 | A | 12/1932 | Erickson |
| 1,905,140 | A | 4/1933 | Boyce |

(Continued)

*Primary Examiner* — Noah Kamen
*Assistant Examiner* — Grant Moubry
(74) *Attorney, Agent, or Firm* — Stephen D. Carver

(57) ABSTRACT

Multi-section sleeve valves for internal combustion engines for improved aspiration. An open connecting rod section is separated from an internal, tubular passageway by a closed wall. A port section proximate the wall defines valve ports. A power stroke midsection borders the port section. An oiling section borders the midsection, and an open section adjacent the oiling section is in fluid flow communication with the tubular passageway. The lower-diameter midsection forms a relief annulus between the valve and the tunnel or sleeve in which the valve is disposed. Fluid flow occurs through the valve interior and through ports dynamically positioned above the compression cylinder, proximate aligned sleeve and head ports. Sleeve ports are separated by bridges that maintain valve rings in compression during reciprocation to prevent damage. High pressure gas is confined between axially spaced apart, stepped sealing rings that prevent gases from flowing axially about the valve exterior.

8 Claims, 21 Drawing Sheets

(56) References Cited

U.S. PATENT DOCUMENTS

| | | | | |
|---|---|---|---|---|
| 1,942,648 | A | | 1/1934 | Jensen |
| 1,995,307 | A | | 3/1937 | Hickey |
| 2,080,126 | A | | 5/1937 | Gibson |
| 2,160,000 | A | | 5/1939 | Rhein |
| 2,164,522 | A | | 7/1939 | Howard |
| 2,021,292 | A | | 5/1940 | Hickey |
| 2,201,292 | A | | 5/1940 | Hickey |
| 2,302,442 | A | | 11/1942 | Hickey |
| 3,522,797 | A | | 8/1970 | Stinebaugh |
| 3,533,429 | A | | 10/1970 | Shoulders |
| 4,765,287 | A | * | 8/1988 | Taylor et al. ..... 123/81 D |
| 5,579,730 | A | | 12/1996 | Trotter |
| 5,941,206 | A | | 8/1999 | Smith |
| 5,967,108 | A | | 10/1999 | Kutlucinar |
| 6,006,714 | A | | 12/1999 | Griffin |
| 6,257,191 | B1 | | 7/2001 | Kutlucinar |
| 6,308,677 | B1 | | 10/2001 | Bohach |
| 6,776,129 | B2 | | 8/2004 | Diehl |
| 7,089,893 | B1 | | 8/2006 | Ostling |
| 7,263,963 | B2 | * | 9/2007 | Price ..... 123/188.4 |
| 7,264,964 | B2 | | 9/2007 | Dang |
| 7,401,587 | B2 | * | 7/2008 | Thomas et al. ..... 123/190.17 |
| 8,087,393 | B2 | * | 1/2012 | Cascia ..... 123/188.4 |

* cited by examiner

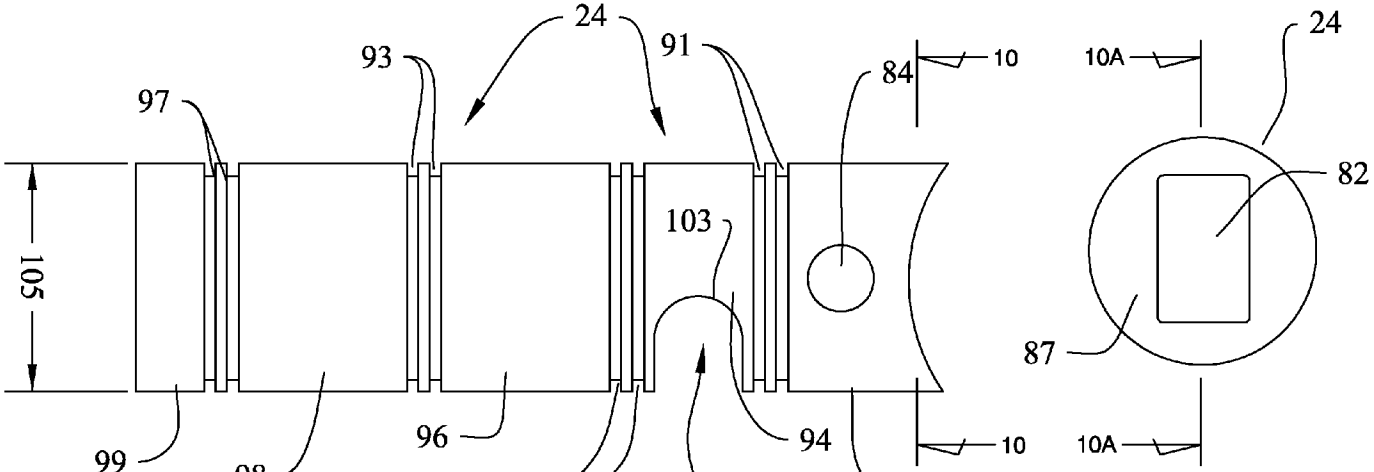
Fig. 10
Fig. 9
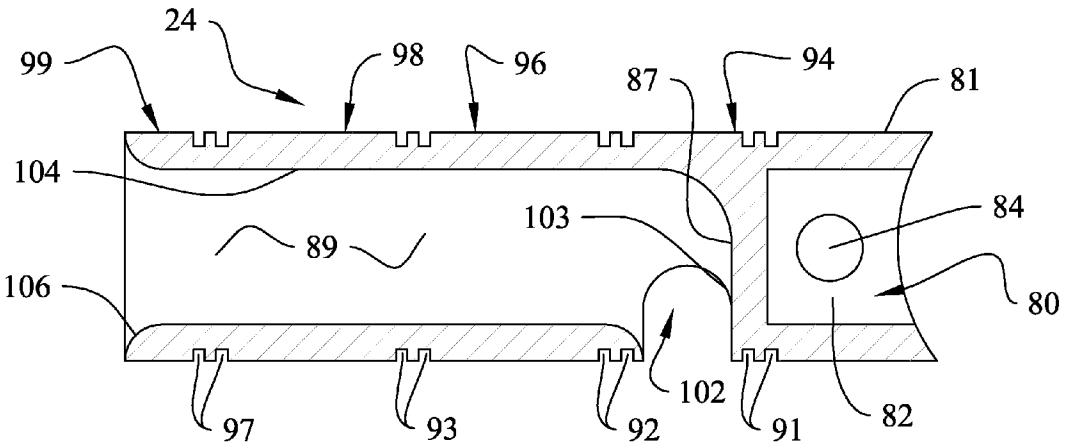
Fig. 10A

Beginning of Intake Stroke

Intake Valve Open at 108°

End of Intake Stroke

Beginning of Power Stroke

Bottom of Power Stroke

End of Exhaust Stroke

Exhaust Valve at
Start of Exhaust Stroke

Exhaust Valve
Fully Open 251°

Exhaust Valve Beginning Closure at Beginning of Intake Stroke 222°

Exhaust Valve Closed at Bottom of Intake Stroke 180°

Exhaust Valve 90° into Compression Stroke

Exhaust Valve at 0° TDC

Fig. 29
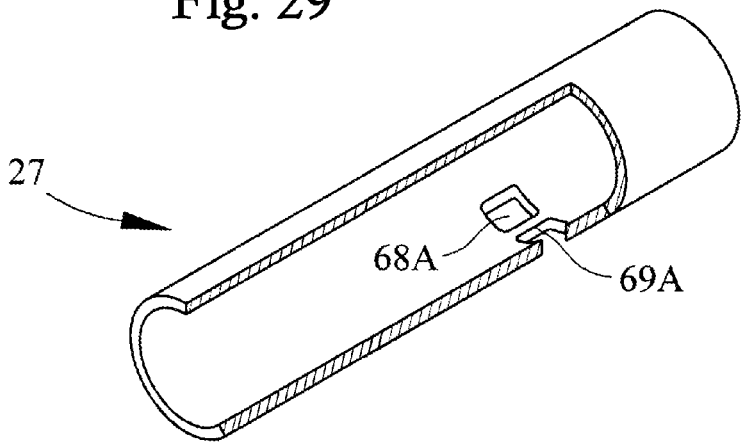
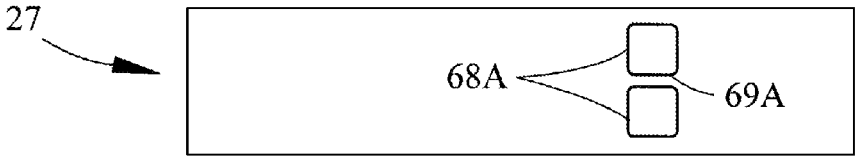
Fig. 30
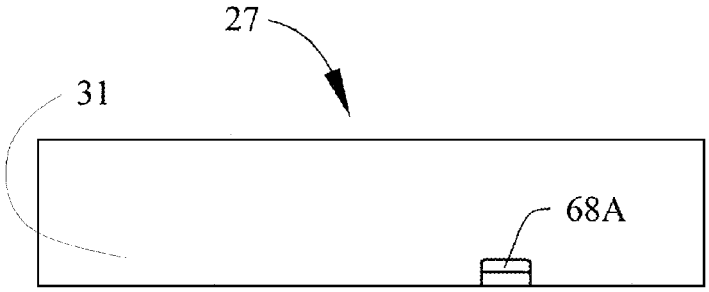
Fig. 31
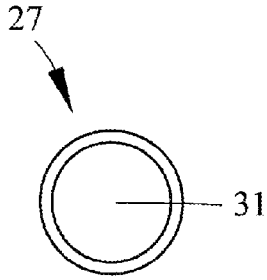
Fig. 32

SLIDING VALVE ASPIRATION

CROSS REFERENCE TO RELATED APPLICATIONS

This utility patent application is a Continuation in Part of Ser. No. 13/443,077, Filed Apr. 10, 2012, entitled "Sliding Valve Aspiration," by inventor Gary W. Cotton, which was a divisional application based upon prior U.S. utility patent application Ser. No. 12/387,184, filed Apr. 29, 2009, Entitled "Sliding Valve Aspiration System," by inventor Gary W. Cotton, now U.S. Pat. No. 8,210,147 issued Jul. 3, 2012, which was based upon a prior U.S. Provisional application entitled "Sliding Valve Aspiration Engine," Ser. No. 61/135,267, filed Jul. 18, 2008, by inventor Gary W. Cotton.

BACKGROUND OF THE INVENTION

1. Field of the Invention

The present invention relates generally to sleeve valve systems for aspirating internal combustion engines, and to internal combustion engines with tubular sliding valves for enhanced aspiration. More particularly, the present invention relates to reciprocating sleeve valve systems for engines equipped therewith of the general type classified in United States Patent Class 123, Subclasses 84, 188.4, and 188.5.

2. Description of the Related Art

A variety of aspiration schemes are recognized in the internal combustion motor arts. In a typical four-cycle firing sequence, gases are first inputted and then withdrawn from the combustion chamber of each cylinder interior during reciprocating piston movements caused by the crankshaft. Gas pathways must be opened and closed during a typical cycle. During the intake stroke, for example, an air/fuel mixture is suctioned through an open intake passageway into the combustion chamber as the piston is drawn downwardly within the cylinder. The intake passageway is typically opened and closed by some form of reciprocating valve mechanism that is ultimately driven by mechanical interconnection to the crankshaft. The combustion chamber must be sealed during the following compression and power strokes, and the valve mechanisms must be closed to block the ports. During the following exhaust stroke, exhaust ports must be opened to discharge spent gases from the combustion chamber.

Spring-biased poppet valves are the most common form of internal combustion engine valve. Typically, poppet valves associated with the intake and exhaust passageways are seated within the cylinder head above the combustion chamber proximate the cylinder and piston. Typical reciprocating poppet valves are spring biased, assuming a normally closed position when not deflected. In a typical arrangement, the bias spring coaxially surrounds the valve stem to maintain the integral valve within the matingly-configured valve seat. Poppet valves are typically opened by mechanical deflection from valve train apparatus driven by camshafts. Typical overhead-valve motor designs include rocker arms comprising reciprocating levers driven by push rods in contact with camshaft lobes. When the camshaft lobe deflects a pushrod to raise one end of the rocker arm, the opposite arm end pivots downwardly and opens the valve. When the camshaft rotates further, the rocker arm relaxes and spring pressure closes the valve. With overhead-cam designs camshafts are disposed over the valves above the head, and valve deflection is accomplished without push rods or rocker arms. Overhead camshafts push directly on the valve stem through cam followers or tappets. Some V-configured engines use twin overhead camshafts, one for each head. Some enhanced DOHC designs use two camshafts in each head, one for the intake valves and one for the exhaust valves. The camshafts are driven by the crankshaft through gears, chains, or belts.

Despite the overwhelming commercial success of poppet-valve designs, there are numerous deficiencies and disadvantages associated with poppet valves. Although poppet valve designs provide manufacturing advantages and cost savings, substantial spring pressure must be repeatedly overcome to properly open the valves. Spring pressure results in considerable drag and friction which increases fuel consumption and limits engine RPM. Poppet valve heads are left within the fluid flow passageway, despite camshaft deflection, and the resulting obstruction in the gas flow pathway promotes inefficiency. For example, back pressure is increased by the valve mass obstructing fluid flow, which contributes to turbulence. Poppet valves are exposed to high combustion chamber temperatures, particularly during the exhaust stroke, that can promote deformation and wear. Thermal expansion of exhaust valves, for example, can interfere with proper valve seating and subsequent sealing, which can decrease combustion performance.

Many of these disadvantages are amplified in high-horsepower or "high R.P.M." applications. Valve deflection in high power applications is often extreme, increasing the amplitude of valve deflection or travel. Damaging valve-to-piston contact can result. As a means of attenuating the latter factor, some pistons are designed with valve clearance regions, but these piston surface irregularities can deleteriously affect the combustion charge and fluid flow through the combustion chamber. Another problem is that the applied drive forces experienced by the valves are asymmetric. The extreme forcing pressure applied by the camshaft to open the valves, for example, is not as uniform as the spring closing pressure. Disharmony between the opening and closing forces contributes to valve lash and concomitant timing problems that interfere with power generation and limit engine R.P.M. Of course, in high power systems involving four or more valves per cylinder, the problems and disadvantages with poppet valve engines are increased proportionally.

So-called "rotary valves" have been proposed for replacing reciprocal poppet valves. Typical rotary valve designs include an elongated tube or cylinder machined with a plurality of gas flow passageways that admit or pass gases. The rotary valves are not reciprocated; they are rotated about their axis to expose passages defined in them in directions normal to their longitudinal axis. Rotary valves must be timed properly to dynamically align their internal passageways with the fluid flow paths of the engine during operation. When rotated to a closing position, the rotary valve passageways are radially displaced, obstructing the normal flow pathways and sealing the engine for firing or compression strokes.

One advantage espoused by rotary valve proponents is the relative simplicity of the design. Further, rotary valves do not penetrate or extend into the cylinder, avoiding potential mechanical contact with the piston, and minimizing fluid flow obstructions. However, the biggest problem with rotary valves relates to ineffective sealing. Although much activity and research has been directed to rotary valve sealing designs, commercially feasible systems have not been perfected. Rotary systems provide inefficient cylinder sealing, lessening firing efficiency, and reducing compression pressure because of leakage. Further, rapid wear of such systems increases the aforementioned problems.

Sliding valves of many configurations are also known in the art. Typical slide valves may be hollow and tubular, or planar, or cylindrical. They are reciprocated within a tubular valve seat region proximate the combustion chamber to alternately open and then close the intake and exhaust passageways. Like rotary valves, sliding valve designs have hitherto been difficult to seal effectively, with predictable negative results.

U.S. Pat. No. 2,080,126 issued May 11, 1937 to Gibson shows a sliding valve arrangement involving a tubular valve driven by a secondary crankshaft. Its reciprocating axis is parallel to the axis of piston deflection. Ports arranged at the side of the piston are alternately opened and closed by piston movements, and gases are conducted through and around portions of the piston exterior.

A similar arrangement is seen in U.S. Pat. No. 1,995,307 issued Mar. 26, 1935, and U.S. Pat. No. 2,201,292, issued May 21, 1940, both to Hickey. The latter patents show designs that aspirate a single working cylinder with a pair of tubular, reciprocating valves that are mounted on either side of the piston and driven by secondary crankshafts. The aspirating valves are forcibly reciprocated between port blocking and port aligning positions. The valves are aligned at an angle slightly off of parallel with the axis of the cylinder.

Other examples of engines with tubular, reciprocating slide valves that move in a direction generally parallel with the drive piston axis are provided by U.S. Pat. Nos. 1,069,794; 1,142,949; 1,777,792; 1,794,256; 1,855,634; 1,856,348; 1,890,976; 1,905,140; 1,942,648; 2,160,000; and 2,164,522 that are largely cumulative.

Hickey U.S. Pat. No. 2,302,442 issued Nov. 17, 1942 shows a tubular, reciprocating sliding valve disposed atop a piston head. The valve slides in an axis generally perpendicular to the axis of the lower drive piston.

U.S. Pat. No. 5,694,890 issued to Yazdi on Dec. 9, 1997 and entitled "Internal Combustion Engine With Sliding Valves" discloses an internal combustion engine aspirated by slidable valves. Tapered, horizontally disposed valve seats are defined near inlet and exhaust ports at the top of the combustion chambers. The slidable valves are tapered to conform to the valve seats. Valve movement is caused by a crankshaft driving a rocker arm that is oriented substantially orthogonal to the rod, whereby crankshaft rotation is translated into horizontal, sliding movements of the planar valves, which reciprocate in a direction normal or transverse to the axis of the piston.

U.S. Pat. No. 7,263,963 issued to Price on Sep. 4, 2007 and entitled "Valve Apparatus For An Internal Combustion Engine" discloses a cylinder head with a cam-driven valve slidably disposed within a valve pocket. The valve, which is displaceable along its longitudinal axis has a tapered portion defining multiple fluid flow passageways. The valve is displaced by cam rotation between a configurations passing gases through the passageways and a configuration wherein the valve flow passageways are closed.

BRIEF SUMMARY OF THE INVENTION

This invention provides an improved sliding valve system for aspirating internal combustion engines, and engines equipped therewith. The system employs tubular, reciprocating sliding valves disposed within sleeves defined within the head secured above the motor's reciprocating pistons. The valves are driven by an independent crankshaft that is exteriorly driven through a pulley.

The sliding valves are positioned within suitable exhaust and intake tunnels in the head. Preferably, sleeves are concentrically disposed around the valves and concentrically fitted within the tunnels. Fluid flow through the valves results through ports defined in the body of the tubular slide valves that are aligned with similar ports in their sleeve, that are in turn aligned with ports dynamically positioned above the compression or combustion region of the cylinder located below the head. Gas pressure develops shearing forces on valve sides. Gases are routed through the tubular interior of the sliding intake valve or valves during intake strokes, and exhaust gases are likewise forced out of the combustion cylinder through the interior of the exhaust valve or valves during exhaust strokes. Pressured gases traveling longitudinally through the valve interior passageways are inputted or outputted through lateral valve ports in fluid flow communication with the internal valve passageways. High pressure gas is confined between axially spaced apart sealing rings that prevent gases from flowing axially about the valve exterior.

All intake and exhaust gas flow is thus confined within the tubular interior of the sliding valves. As a result, gas pressure does not develop a substantial resistive force upon leading surfaces of the valve in a direction coincident with the direction of valve travel. Instead gas pressure that might otherwise resist valve travel, and add to friction, is applied as a shear force, and pressure is evenly distributed in the relief annulus. Gas flow is distributed through the valve interior rather than around it, and friction is substantially reduced.

Importantly, the port sizes are maximized for efficient breathing. However, in the past, large sliding valve ports have contributed to inefficiency, reduced sealing, and premature valve failure. In the present design, the slide-valve sleeves are provided with a unique connecting bridge that traverses the port area, aligned with the direction of sliding valve travel. When the valves slidably reciprocate through this region, their sealing rings are supported tangentially by the bridges, to maintain ring integrity. Importantly, the present design includes an oiling section on the sliding valves with an additional sealing ring.

Thus a basic object of my invention is to provide a highly efficient, sliding valve aspiration system for internal combustion engines, particularly four-cycle designs.

A related object is to provide an improved sliding valve that is ideally employed with four cycle, internal combustion engine.

A related object is to improve combustion efficiency within an internal combustion engine. It is a feature of our invention that its advantageous overhead valve geometry and the reduction of valve-train parts needed for the invention increase overall efficiency.

Another important object is to preserve the sealing integrity of sliding valves. One important feature of the invention in this regard is that the head ports are provided with bridges that support the valve sealing rings during motion. Another important feature is the addition of a fourth sealing ring proximate a separate oiling section.

Another basic object is to provide a valve system for internal combustion engines that provides an enhanced power stroke. In other words, it is a feature of this invention that a higher proportion of the total 720 degrees of crankshaft rotation during typical four cycle operation occurs during the power stroke.

Another important object is to provide a sliding valve system of the character described that does not affect combustion chamber volume during operation. Important features of my invention are the fact that chamber expansion during valve displacement is avoided, and that the porting path does not consume the operational compression volume.

A related object is to provide a valve system of the character described wherein the valve structure does not enter the combustion chambers.

Another object is to provide a valve deflection system that applies force symmetrically, to minimize valve lash and allow higher engine speeds.

Yet another basic object is to minimize friction. It is a feature of my invention that spring-biased poppet valves and the typical frictional cam shafts and associate linkages such as rocker arms used to reciprocate poppet valves are avoided.

A still further object is to provide a valve system of the character described that is driven externally by a belt, so that efficiency is increased and complexity is reduced.

Another important object is to avoid so-called "split-lift" applications used in the prior art for aspirating motors.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 9 is a side elevational view of my new sliding valve;

FIG. 10 is an end elevational view of the valve of FIG. 9, looking generally in the direction of arrows 10-10;

FIG. 10A is a longitudinal sectional view of a preferred sliding valve, derived generally in the direction of arrows 10A-10A in FIG. 10;

FIG. 29 is an isometric view of a preferred valve sleeve, with portions broken away for clarity;

FIG. 30 is a bottom plan view of the sleeve of FIG. 29;

FIG. 31 is a side elevational view of the sleeve of FIG. 29;

FIG. 32 is an end elevational view of the sleeve of FIG. 29;

DETAILED DESCRIPTION OF THE INVENTION

Figure 1:
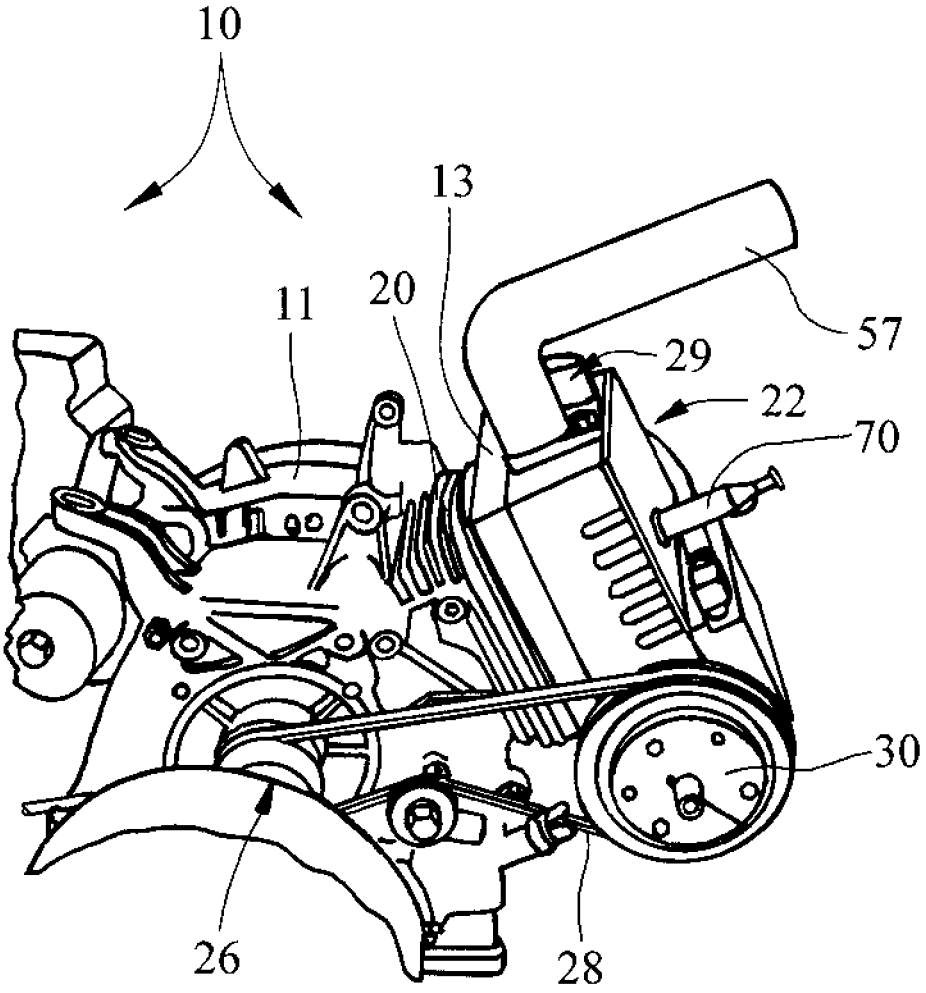
FIG. 1 is a fragmentary, isometric view of a one-cylinder, internal combustion engine constructed in accordance with the best mode of the invention known at this time.
Figure 2:
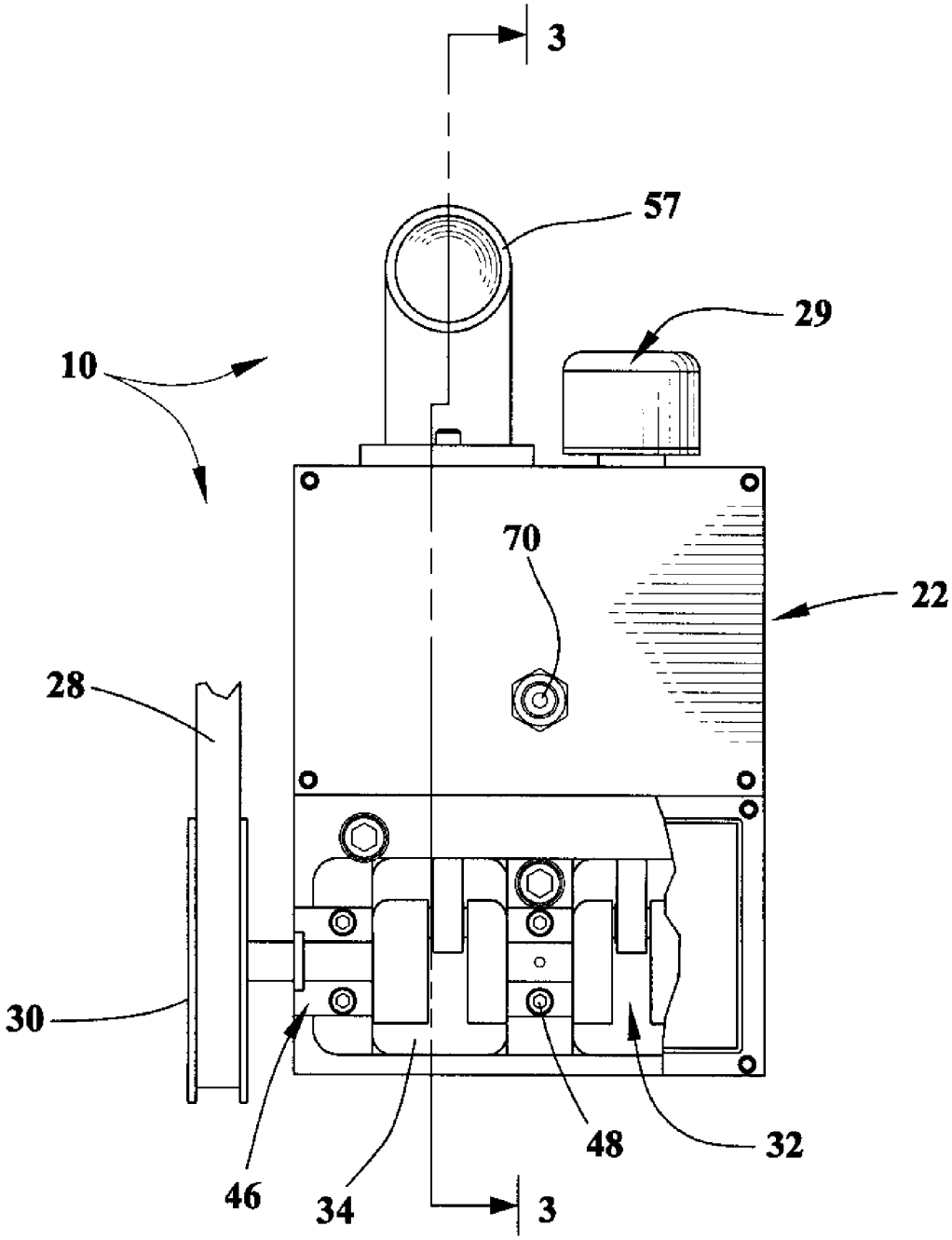
FIG. 2 is an enlarged, fragmentary, plan view of the engine taken generally from a position to the right of FIG. 1, with portions thereof broken away or shown in section for clarity.

For purposes of providing an enabling disclosure, prior U.S. patent application Ser. No. 13/443,077, Filed Apr. 10, 2012, entitled Sliding Valve Aspiration, by inventor Gary W. Cotton, and U.S. Pat. No. 8,210,147 issued Jul. 3, 2012, Entitled "Sliding Valve Aspiration System," by inventor Gary W. Cotton, are hereby incorporated by reference as if fully set forth herein.

With initial reference directed to FIGS. 1-5 of the appended drawings, a basic single-cylinder, four-cycle internal combustion engine equipped with the aspiration system constructed in accordance with the best mode of the invention has been generally designated by the reference numeral 10. It should be understood that the aspiration system as herein described is suitable for use with engines equipped with multiple cylinders, arrayed in the popular V-configuration or other configurations. The engine 10 has a rigid block 11 housing a primary crankshaft 12 (FIG. 3) of conventional construction that drives a reciprocating power piston 14 (FIG. 3) with a conventional connecting rod 16. The basic engine illustrated comprises a Honda thirteen-horsepower motor, which is modified as hereinafter described. The engine configuration as illustrated can be varied considerably according to recognized standards known to those with skill in the art.

The standard combustion power piston 14 reciprocates within a cylinder 18 (FIG. 3) that is externally air-cooled with multiple, external heat dissipation fins 20 (FIG. 1) proximate the engine deck 13 (FIG. 1). The basic construction of piston 14 and its accessories is substantially conventional and is not critical to practice of the invention. The instant sliding valve system is disposed within a head, generally indicated by the reference numeral 22 (i.e., FIGS. 3-5, 7, 11), that mounts conventionally above the engine deck 13 above the conventional piston 14 and cylinder 18 described previously. Piston 14 moves it upwardly and downwardly in a direction substantially perpendicular to head 11. For purposes of this invention, the term "head" shall generally designate that region of an internal combustion engine enclosing the combustion chambers, above the pistons. Such a head may be a conventional, separate part bolted atop the engine, or in some cases the "head" may be integral with the engine block in a single casting that is thereafter appropriately machined.

Figure 4:
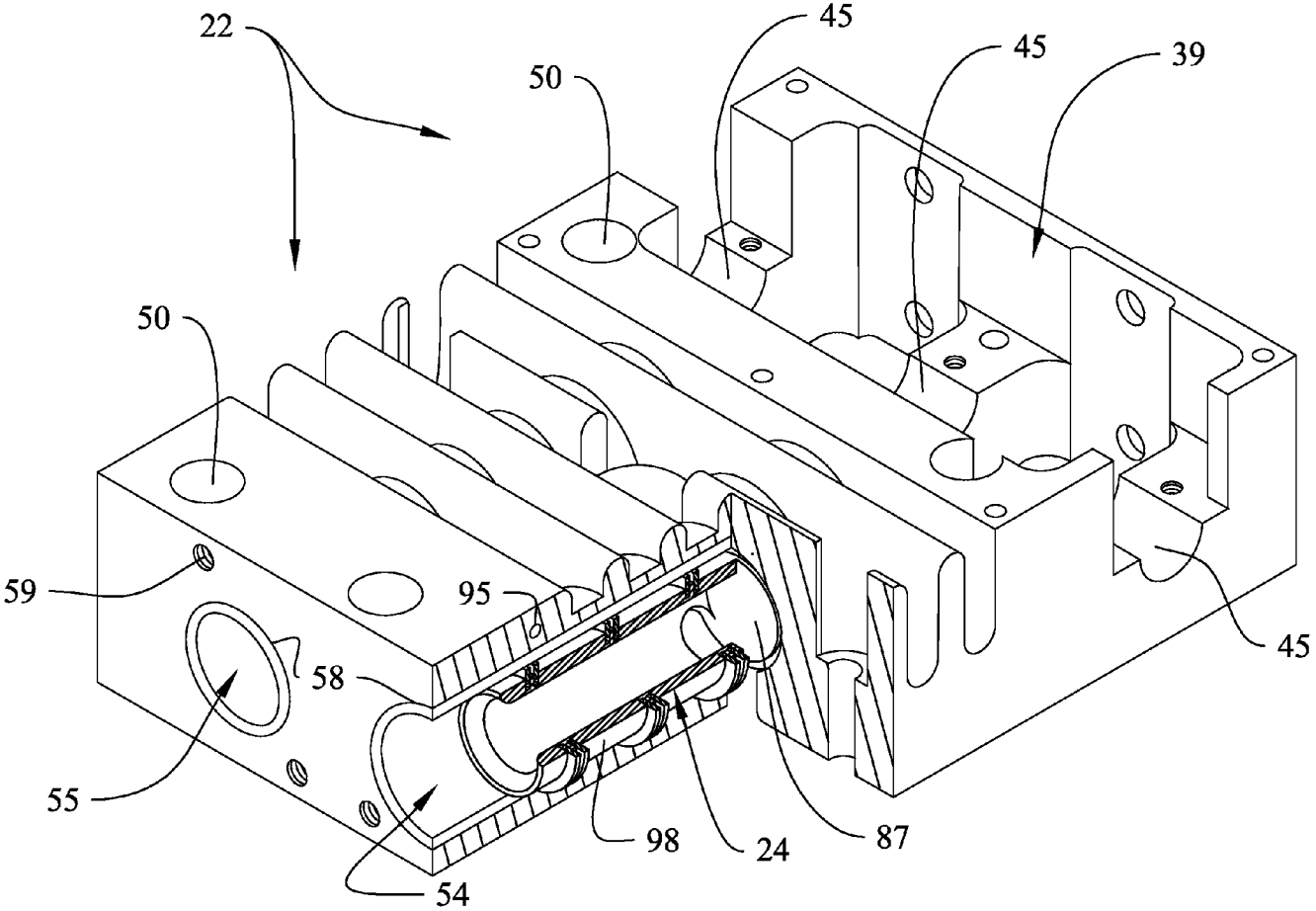
FIG. 4 is an enlarged, fragmentary, isometric view of the preferred cylinder head assembly, with portions thereof broken away or shown in section for clarity or omitted for brevity.
Figure 5:
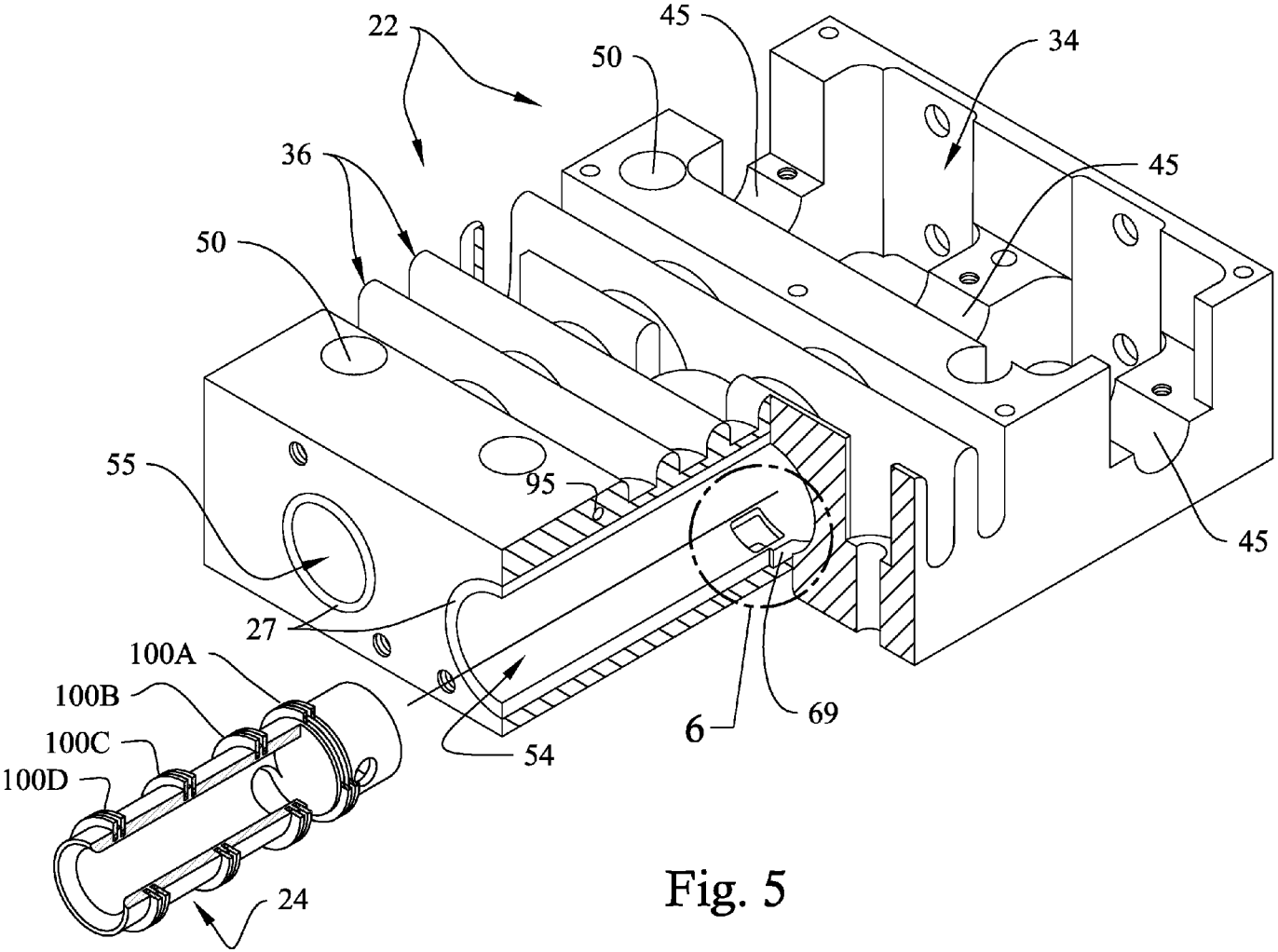
FIG. 5 is an enlarged, partially exploded fragmentary isometric view of the cylinder head assembly of FIG. 4, with my new sliding valve removed from its sleeve, and with portions thereof broken away or shown in section for clarity.

With additional reference directed primarily now to FIGS. 4-11, head 22 houses a pair of tubular, slide valves 24, 25 (FIGS. 4, 5 8-11) that aspirate the cylinder 18. In the best mode known at this time, the tubular exhaust valve 24 and the tubular intake valve 25 are made from titanium. While those skilled in the art will recognize that several alloys of titanium and/or titanium steel are available, my experiments have yet to reveal the ideal composition of these critical valves. Ordinary steel compositions however, result in heat damage and premature wear and failure. Furthermore, as illustrated in FIG. 5, for example, the sliding valves 24, 25 are mounted in appropriately ported sleeves 27 that fit into the cylinder head 22 and line up and register with the appropriate ports in the head. While sleeveless sliding valve designs are functional, sleeves are much preferred. It is also preferred that the sleeves be coated by treating them with Nickel-boron.

Figure 11:
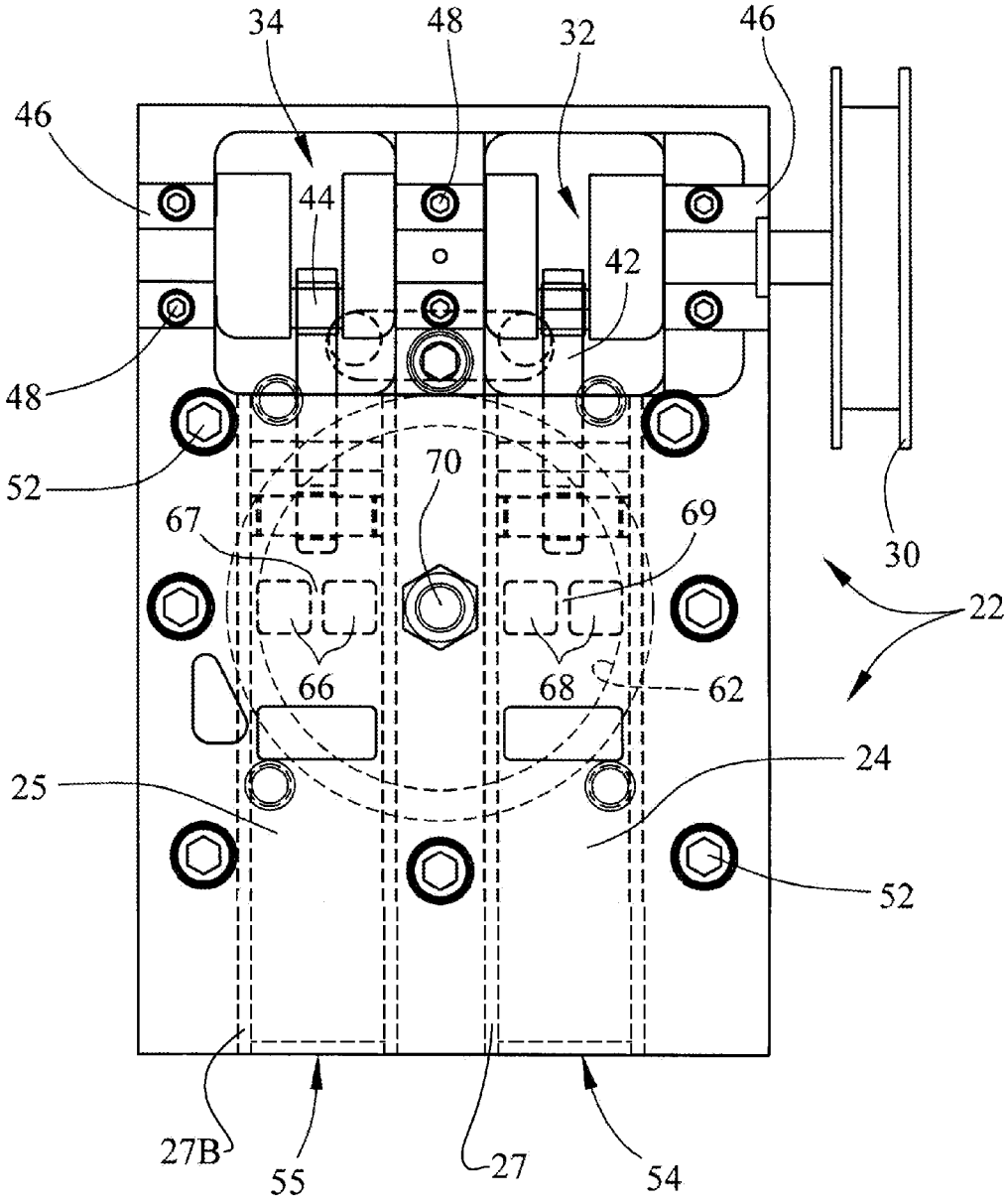
FIG. 11 is an enlarged top plan view of the preferred cylinder head, with phantom lines illustrating various internal parts, and with portions broken away or shown in section for clarity.
Figure 25:
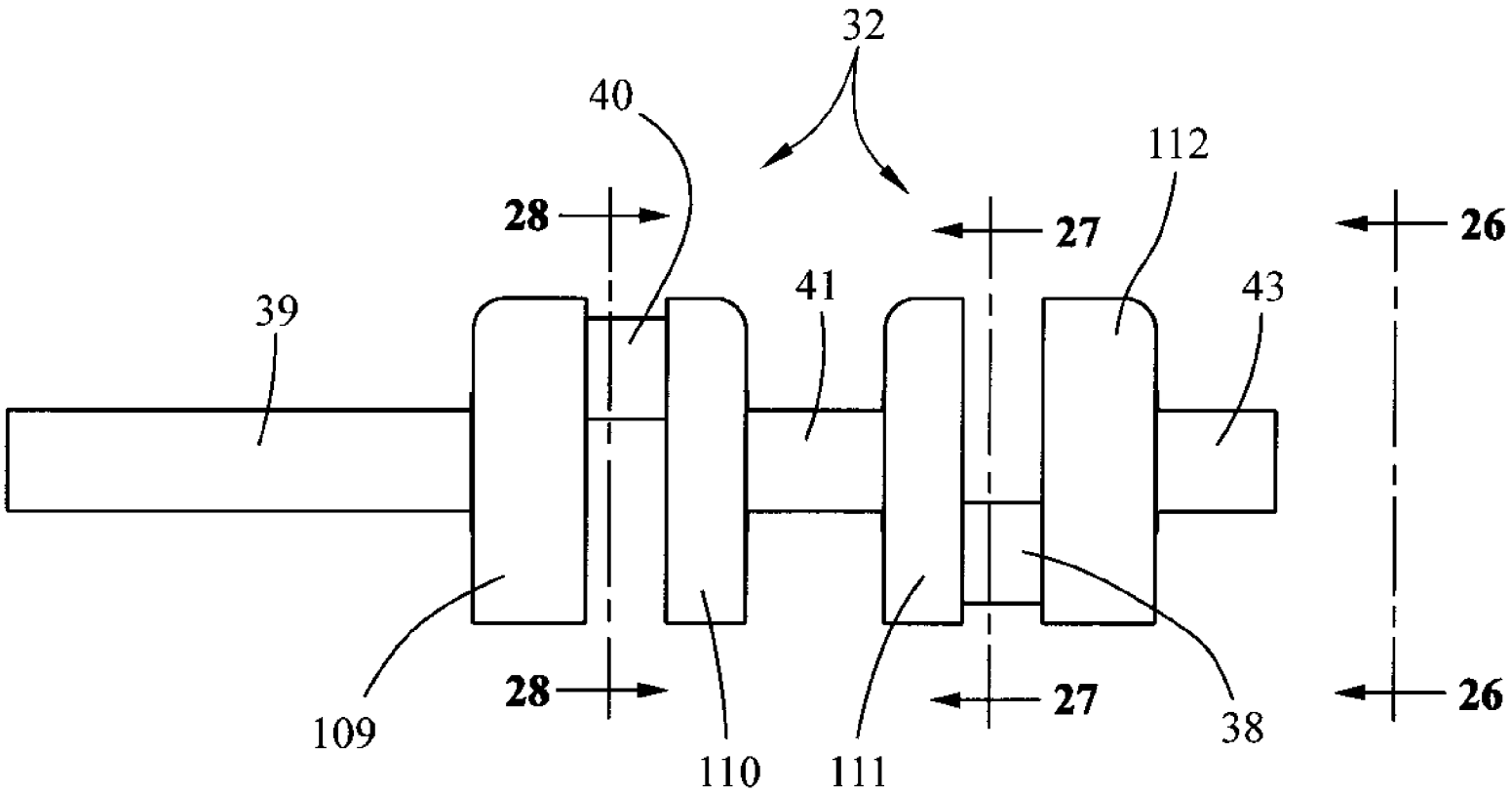
FIG. 25 is a longitudinal diagrammatic view of the preferred secondary crankshaft that operates the intake and exhaust valves and moves them between positions illustrated in FIGS. 13-24.
Figure 28:
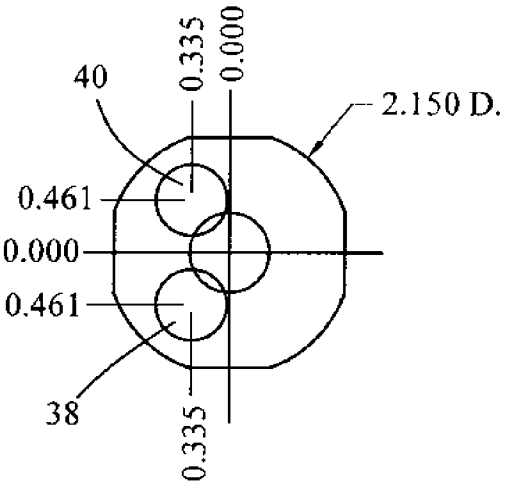
FIGS. 26-28 are sectional views taken respectively along lines 26-26, 27-27, and 28-28 of FIG. 25.
Figure 27:
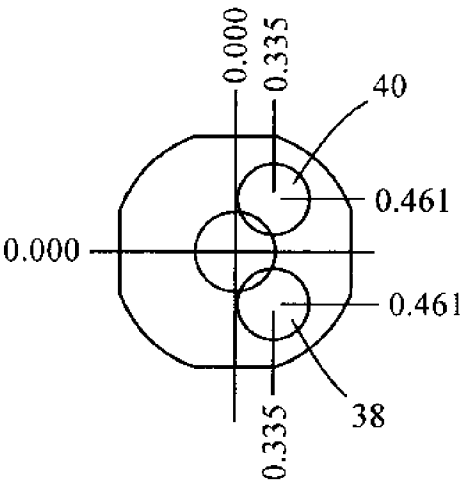
Figure 26:
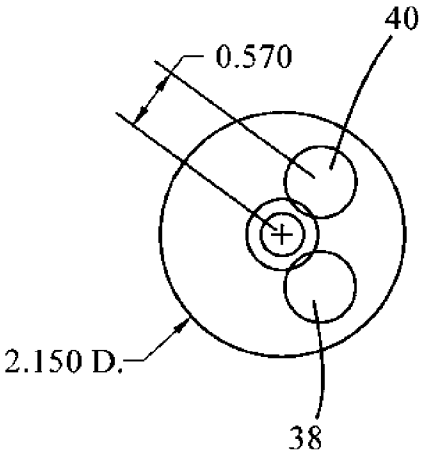

A drive pulley 26 (FIG. 1) driven by conventional internal crankshaft 12 (FIG. 3) is connected via drive belt 28 to a valve pulley 30 that drives the slide valve crankshaft 32 housed within head 22. Crankshaft 32, best seen in FIG. 11, is mounted perpendicularly relative to sliding valves 24, 25. It extends across and through compartmentalized crankshaft mounting region 34 (FIG. 5) across the top (i.e., as viewed in FIGS. 4, 5) of the head 22. Region 34 (FIG. 3) contains liquid oil for lubricating the crankshaft and the slide valves to be described and it is normally covered by shroud 35. The crankshaft exhaust journal 38 and the crankshaft intake valve journal 40 (i.e., FIG. 25) of crankshaft 32 support connecting rods 42, 44 that respectively operate exhaust slide valve 24, and intake slide valve 25. Aligned and integral crankshaft portions 39, 41, 43 (i.e., FIG. 25) are rotatably constrained within conventional saddles 45 within mounting region 34 (i.e. FIG. 4, 5) and mounted with conventional bearing assemblies 46 (FIG. 2) as known in the art. In the best mode it is proposed that the counterweight sections 109, 110, 111, and 112 of the crankshaft (FIG. 25) be drilled appropriately for crankshaft balancing. Preferably the rotating and reciprocating aspiration slide valve assembly may thus be "balanced" and "tuned" for optimal aspiration performance.

Figure 7:
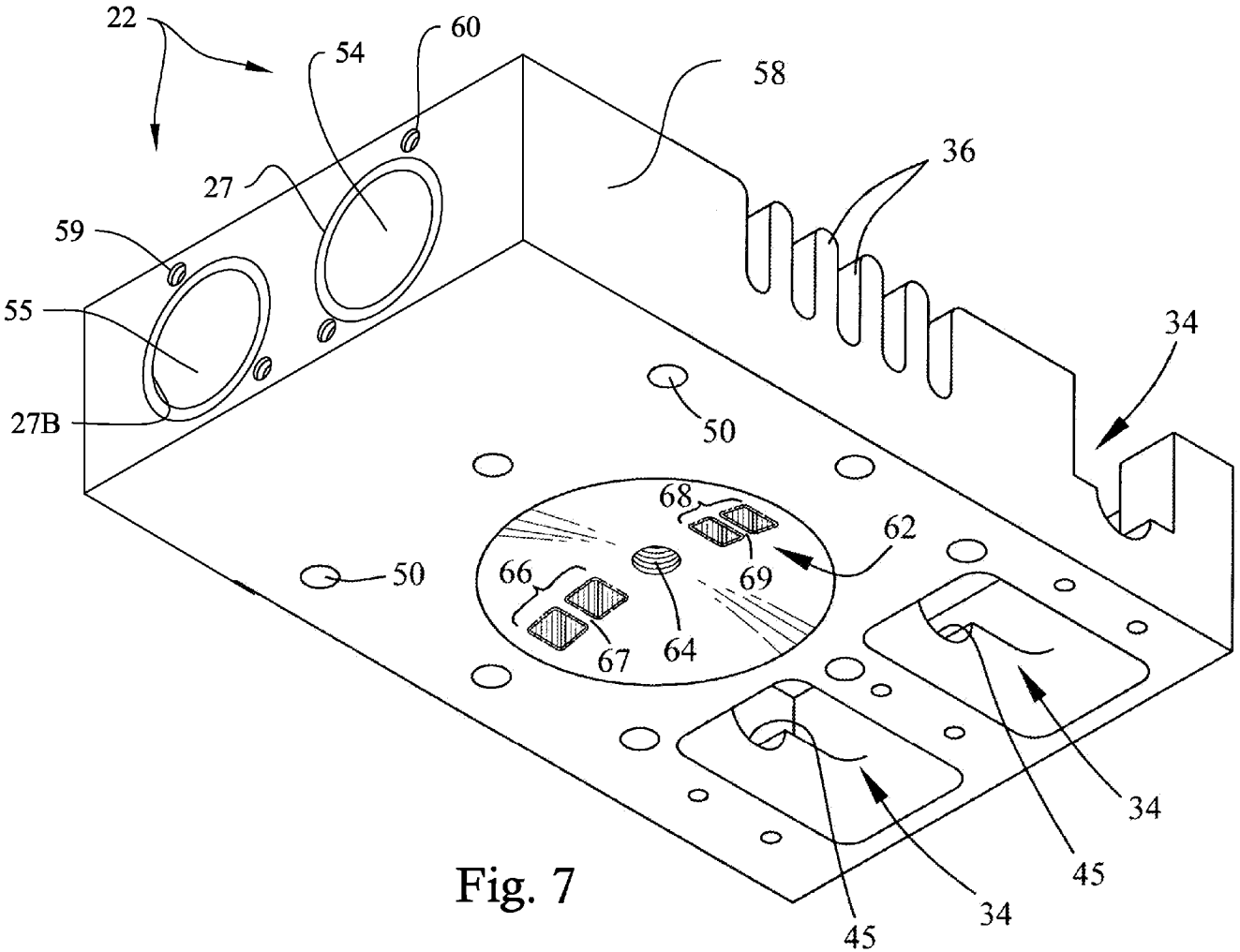
FIG. 7 is an enlarged bottom isometric view of the preferred cylinder head.

The crankshaft bearing assemblies 46 are bolted within crankshaft region 34 to mount the slide valve crankshaft 32 over the saddles 45 are secured with a plurality of bolts 48. As best seen in FIGS. 4, 5 and 7, head 22 includes a plurality of spaced apart mounting orifices 50 through which head bolts 52 (FIG. 11) extend when mounting the head 22 to the deck 13.

The intake sliding valve 25 (i.e., FIG. 11) is slidably received within a sleeve 27B disposed within head tunnel 55 (FIGS. 4, 11), that is spaced apart from and parallel with exhaust tunnel 54 and sleeve 27. Tunnels 54 and 55 are oriented generally perpendicularly to the stroke of the power piston 14. Exhaust sliding valve 24 slidably reciprocates within sleeve 27 concentrically disposed within tunnel 54. Sleeves 27, 27B (FIGS. 5, 29-32) require ports aligned with head ports and valve described hereinafter, as appreciated by those skilled in the art. An air-fuel mixture is drawn into intake valve tunnel 55 from a conventional carburetor 29 (FIG. 2) mounted with screws received within orifices 59 (FIG. 4). Alternatively the invention may be used with fuel injection systems.

As best viewed in FIGS. 29-32, each sleeve 27 is elongated and tubular. Each has a pair of spaced apart open ends 31 defining opposite ends of an elongated cylindrical passageway in which the sliding valves 24 and/or 25 are inserted. A pair of ports 68A are separated by a bridge 69A (FIG. 29) that maintains pressure on the sliding valve rings during operation. While both sleeves are identical in dimensions and geometry, the exhaust sleeve should be of a more expensive heat resistant alloy. It is preferred that the exhaust sleeve be made of Steelite or Nickalloy heat resistant titanium steel alloy.

This invention requires maximal air flow quickly. In other words, it is preferred that the carburetor 29 have a relatively large throat with a relatively short venturi. In the model depicted in the drawings, which has been thoroughly tested, a Honda 350 cc. "dirt bike" motorcycle carburetor is preferred.

Exhaust valve 24 is slidably constrained within its sleeve 27 in tubular tunnel 54 (FIGS. 5, 7, 11). The exhaust header 57 (FIG. 1) is preferably screw-mounted upon the head's end surface 58 (FIGS. 4, 7) with suitable screws that penetrate orifices 60 (FIG. 7). Head cooling is encouraged by fin areas 36 (FIGS. 5, 7).

As best seen in FIG. 7, the circular combustion chamber 62 includes a central, threaded spark plug passageway 64 that is spaced between intake ports, collectively numbered 66, and exhaust ports, collectively numbered 68 (FIG. 7). A conventional spark plug 70 (i.e., FIGS. 1, 11) is threadably mated to passageway 64, with its electrodes positioned and centered within combustion chamber 62.

Figure 6:
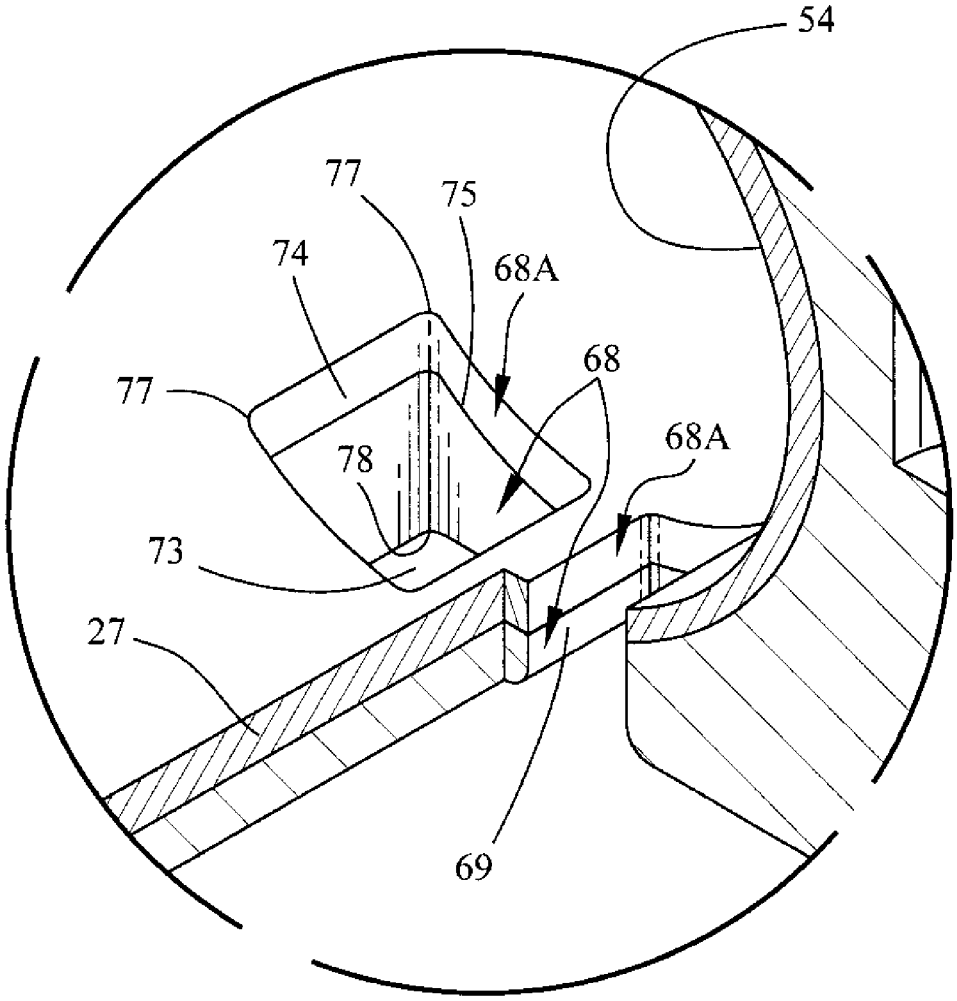
FIG. 6 is an enlarged, fragmentary isometric view taken generally from circled region "6" in FIG. 5.

As seen in FIGS. 29-30, for example, adjacent sleeve ports 68A are separated from one another by a central bridge 69A. Similarly intake ports 66 in the head (FIG. 7) built into the combustion chamber may be separated with a bridge 67 that is integral with the head 22. Similarly, a rigid, centered bridge 69 in the head separates the twin exhaust ports 68 (FIGS. 6, 7). These ports in the head must align with the valve sleeve ports 68A seen in FIGS. 29-32.

As best seen in FIG. 6, each head exhaust port 68 aligns with sleeve port 68A. The composite ports have smooth, downwardly inclined sidewalls 74, 75 that are polished for maximal fluid flow. These walls communicate with a lower orifice 73 in the head that opens to the combustion chamber 62. The intake ports 66 (i.e., FIG. 7) are similarly configured. Importantly, it is desired that corner ridges of the structure be radiused for maximum fluid flow, as illustrated by gently radiused corner regions Importantly, rigid, transverse bridges 69A are integrally formed in the sleeve port regions and bisect these regions into twin, side by side orifices 68A (FIG. 29). The head is similarly ported. In FIG. 7, for example, there are two pairs of ports 66 and 68 respectively separated by bridges 67, 69. Sleeve 69A bears against critical sealing rings associated with the sliding valves 24 and 25, as discussed below. By pressuring the sealing rings during valve travel, deformation of the critical sealing rings in the region of the various exhaust ports 68 and intake ports 66 is prevented. As sealing of the tubular slide valves 24, 25 is critical to the invention, bridges 67 and 69 are vital to the best mode of the invention.

With joint reference directed now primarily to FIGS. 8-12 and 10A, valves 24 and 25 are structurally virtually identical, so only exhaust valve 24 will be detailed. However, the exhaust valve 24 runs at higher temperatures, and thus requires more heat resistance, so it is preferably fabricated from a premium grade of titanium alloy steel.

Figure 12:
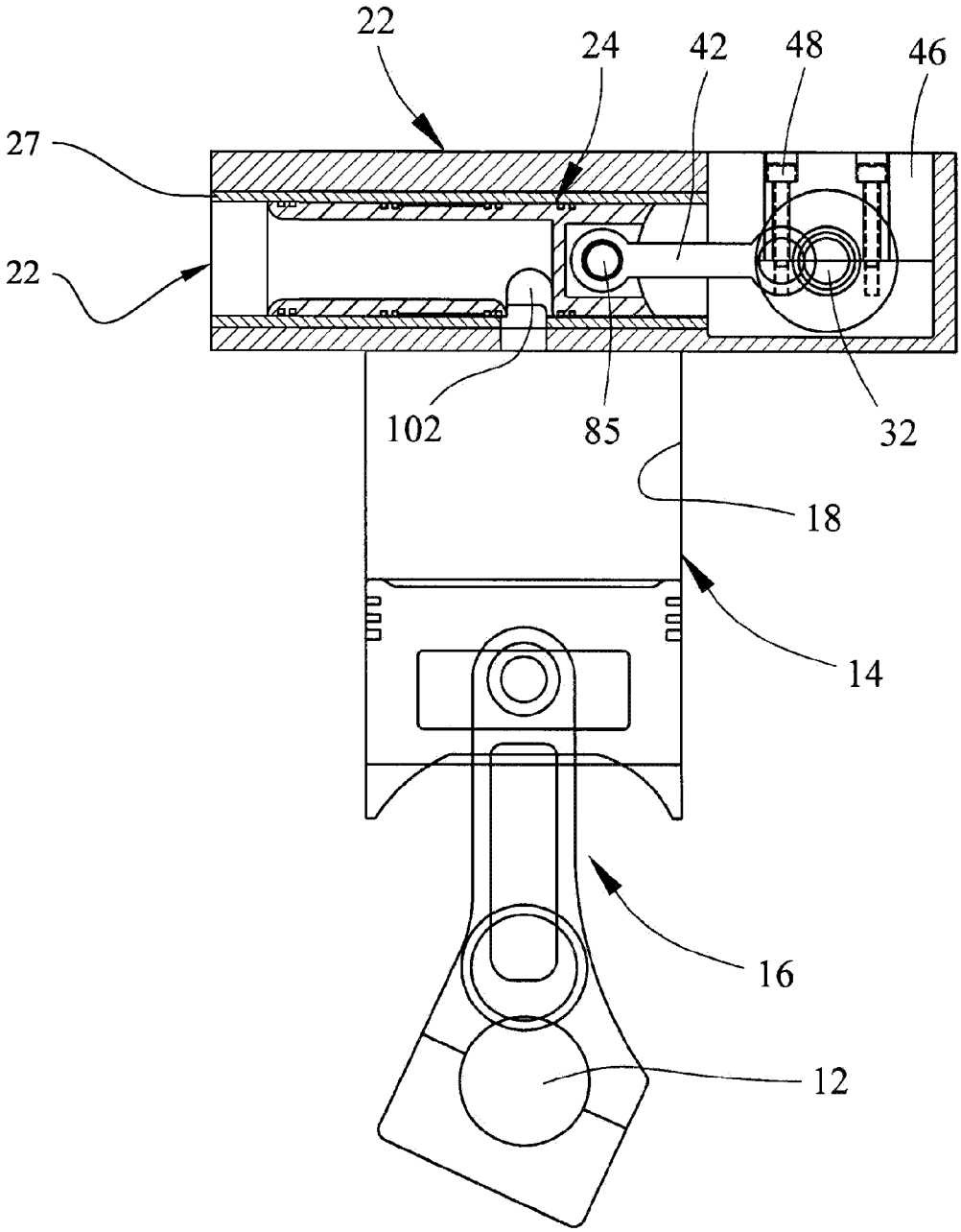
FIG. 12 is an enlarged, fragmentary diagrammatic view showing the basic arrangement of the engine power cylinder, the head, the overhead exhaust valve, and the exhaust valve sleeve.

With emphasis directed to FIGS. 8-10 and 10A, each slide valve 24, 25 is elongated, substantially tubular, and multi-sectioned. An open connecting rod section 80 (i.e., FIG. 10A) enables mechanical connection to the connecting rod 42 (FIG. 12). The end of rod 42 extends into the interior 82 of section 80 and is journalled by wrist pin 85 (FIG. 3) and is conventionally secured between wrist pin orifices 84 (FIGS. 9, 10A). Importantly, valve section 80 ends in a closed interior wall 87 that separates interior region 82 and the connecting rod structure from the rest of the tubular interior passageway 89 (FIG. 10A) of the valve 24. The open end of the interior passageway 89 within each valve directly communicates through tubular tunnels 54, or 55 (FIG. 4) for aspiration fluid flow. The exterior surface 81 of valve rod section 80 (FIGS. 9, 10A) is preferably cross hatched by machining to promote oil flow and distribution.

In the best mode each valve has four pairs of external ring grooves to seat suitable sealing rings. For example, a pair of concentric and parallel ring grooves 91 separate valve rod section 80 from the adjacent port section 94 (FIGS. 9, 10A). Ring grooves 92 separate port section 94 from the adjacent "power stroke" midsection 96. Similarly, ring grooves 93 separate midsection 96 from adjacent oiling section 98. Finally, a fourth set of ring grooves 97 separates oiling section 98 from terminal open section 99. Establishment of the separate oiling section 98 aids in lubrication and sealing, and cooling effects.

Figure 8:
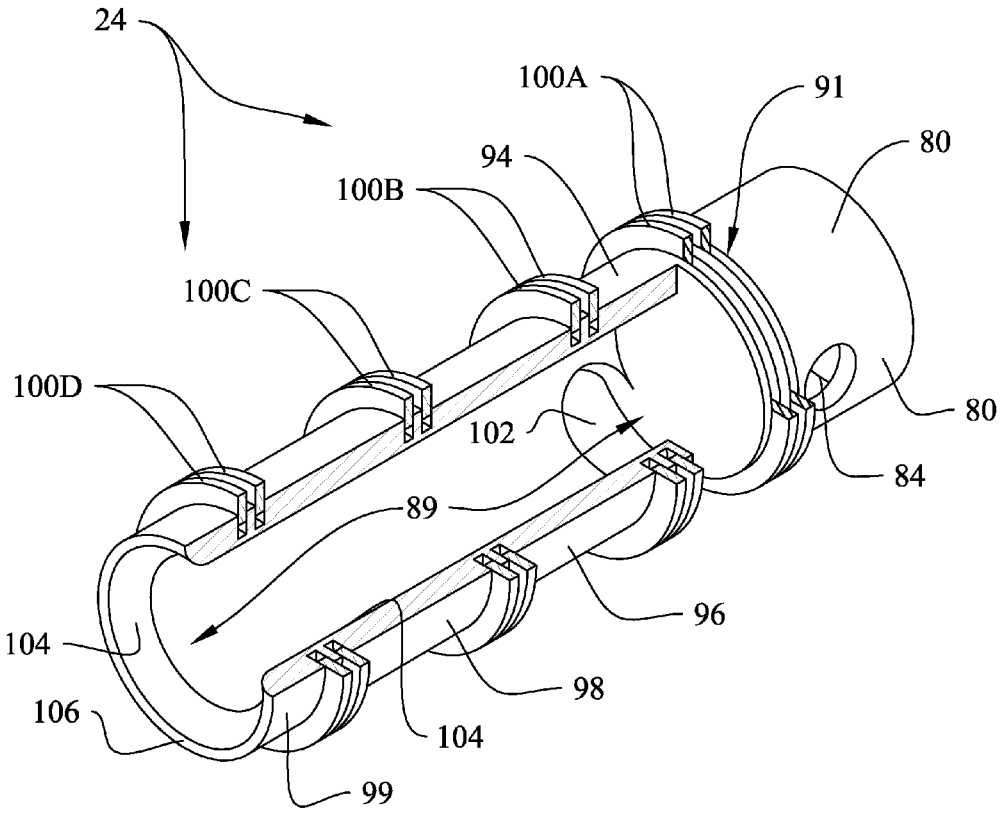
FIG. 8 is an enlarged isometric view of my new valve, with portions thereof broken away or shown in section for clarity.

A comparison of FIGS. 8 and 9 reveals that ring groove pairs 91, 92, 93, and 97 seat pairs of spaced apart, concentric sealing rings 100A, 100B, 100C, and 100D respectively, that are externally, coaxially, mounted about each valve exterior. Valve rod sections 80 and oiling section 98 are in fluid flow communication with head region 34 that contains lubricating oil. Thus rings 100A and 100D are oil rings. Port 95 (FIG. 4) delivers a mist of oil to the preferably reduced diameter valve oiling section 98. It will be recognized by those skilled in the art that when the valves 24 or 25 are fitted within their sleeves 27, (i.e., FIG. 5) the rings 100A, 100B, 100C or 100D will substantially. flushly seat within the respective ring grooves 91, 92, 93 and/or 97 (i.e., FIG. 9) and the exterior of the rings will be flush with the cylindrical outside body of the valves 24, 25, slidably touching the interior surfaces of the captivating sleeves 27.

Figure 35:
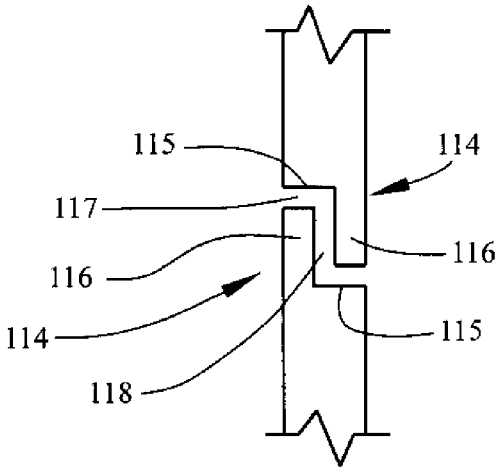
Figure 33:
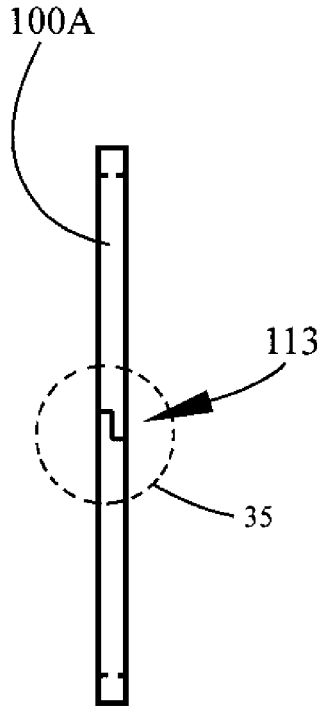
FIG. 33 is an enlarged, side elevational view of a preferred sealing ring used with the sliding valves.
Figure 34:
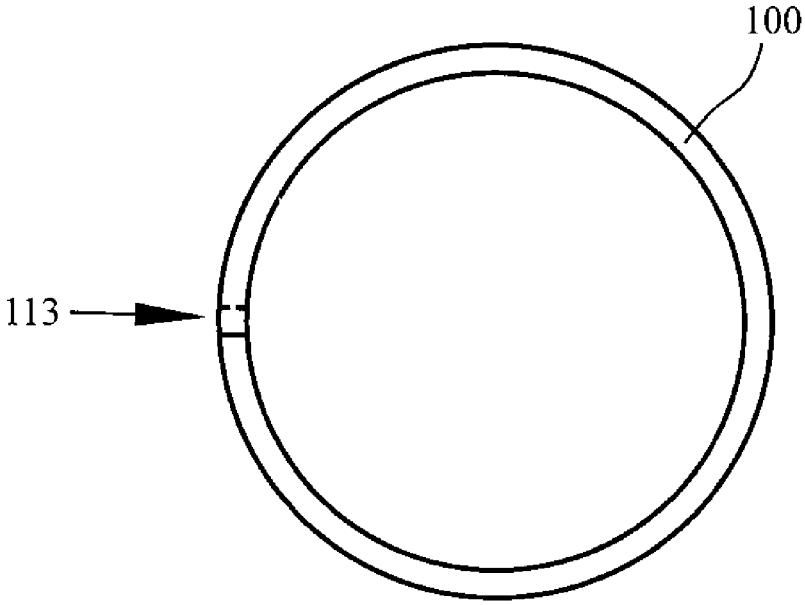
FIG. 34 is an enlarged, plan view of a preferred sealing ring used with the sliding valves; and, FIG. 35 is an enlarged, fragmentary plan view of circled region 35 in FIG. 33.

Each sealing ring 100A, 100B, 100C, and 100D is preferably made of heat treated and heat resistant nickel alloy steel. As best seen in FIGS. 33-35, the compressively touching ends of the rings are stepped in the best mode to form an overlapped intersection 113 that forms an improved pressure seal. Preferably, each end of a given ring is configured in the overlapping or stepped configuration of FIG. 35, where abutting ring ends comprise a notched region 115 and a bordering, elongated tabbed region 116. The tabbed regions 116 are variably spaced apart from notched regions 115, with end gaps 117 therebetween. The parallel, spaced apart ring end gaps 117 allow for thermal expansion and contraction of the rings during operation. However, a sealing gap 118, which is perpendicular to gaps 117, is defined between mutually aligned and abutting tabbed regions 116. Gap 118 is much smaller than indicated, and provides a seal, as end regions 116 abut in operation, and seal the gaps for compression. At the same time gaps 117 allow for normal thermal expansion and contraction.

Figure 3:
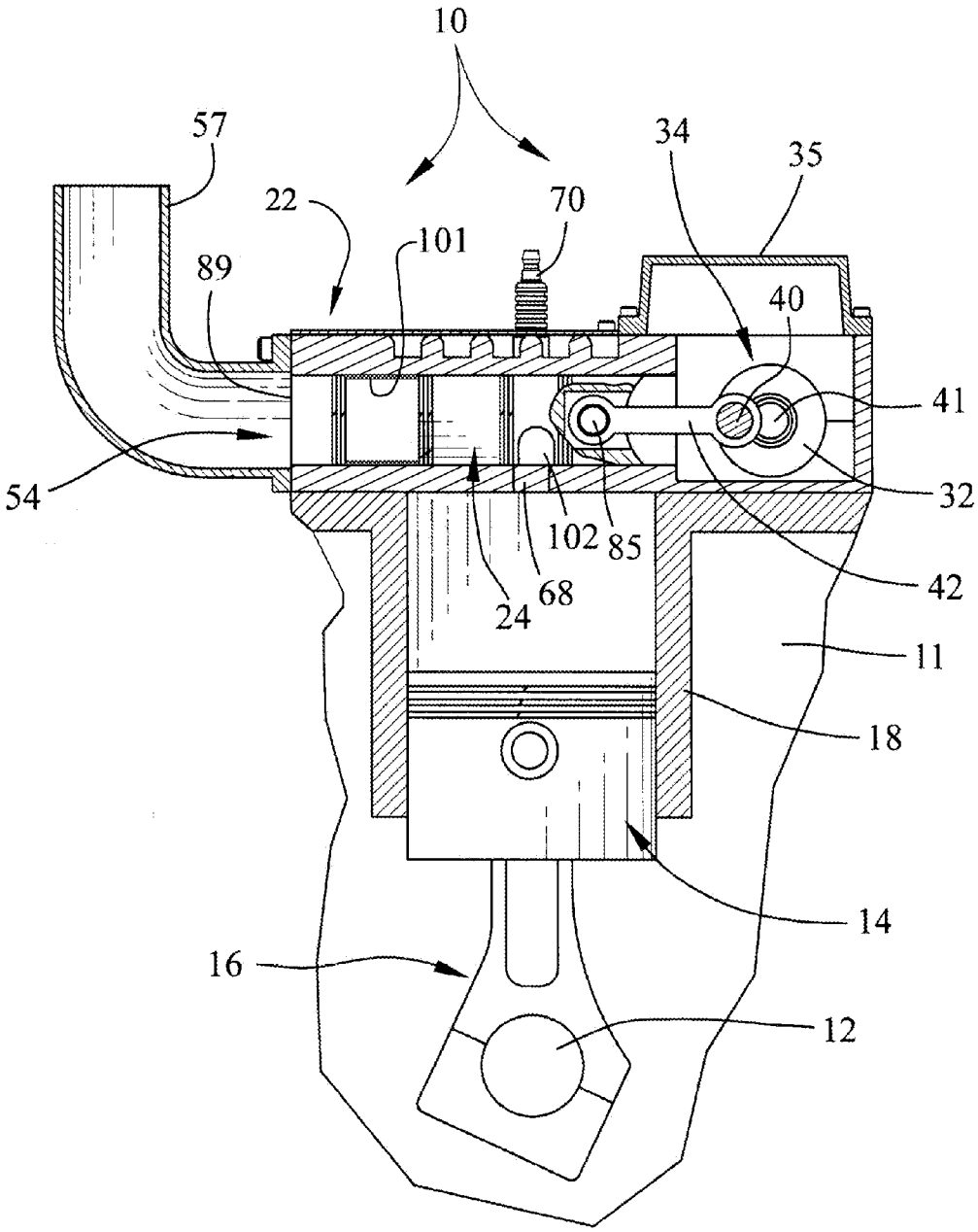
FIG. 3 is an enlarged, fragmentary sectional view taken generally along line 3-3 of FIG. 2.

Importantly, the valve port section 94 (FIGS. 8, 9) includes an enlarged, arcuate cutout 102 functioning as an aspiration port (i.e., either exhaust or intake). Port 102 radially extends about approximately 30-40 percent of the radial periphery of the valve. A gently radiused arch 103 above port 102 (FIGS. 8, 10A) leads to the smoothly configured, generally cylindrical passageway 89 that leads to the exterior of the valve. Passageway 89 (FIG. 10A) comprises tubular interior passageway walls 104, terminating in gently radiused, flared lips 106 (FIG. 10A) at the valve end that maximize fluid flow. Aspiration occurs when valve ports 102 are aligned with sleeve ports 68A (FIG. 32) which are in turn aligned with head port pairs 66 or 68 (FIG. 7), in response to timed, reciprocal movements caused by the valve crankshaft 32 previously described. Thus when port 102 (FIGS. 3, 9) of the exhaust valve 24 overlies sleeve ports 68A (FIG. 32) and head ports 68 (FIG. 7), hot exhaust gases may be vented away from the combustion chamber 62 and lower cylinder 18 in response to upward movement of the power piston 14 towards top-dead-center. At this time exhaust gases are vented to the left (as viewed in FIG. 9) through port 102, along the valve interior passageway 89 (FIG. 8) and through head tunnel 54 (FIG. 7) and out header 57 (FIGS. 1, 3). Similarly, during the intake stroke, air and raw fuel is drawn through carburetor 29 into the head 22 through tunnel 55 (FIG. 7), and into the passageway 89 in the intake valve 25, through its port 102 and into the cylinder combustion region through head ports 66 (FIG. 7) and aligned sleeve ports 68A.

Importantly, as slide valves 24, 25 reciprocate, their multiple sealing rings 100 are prevented from deformation while traversing sleeve ports 68A by the bridges 69A (i.e., FIG. 32).

Referencing FIG. 9, the arrow 105 indicates the outside diameter of the majority of the length of valve 24. Sections 80, 94, 96 and 99 are all of this diameter. Valve oiling section 98 however, has a slightly reduced diameter in the best mode. Thus a cylindrical or annular region 101 (FIG. 3) is defined radially around the external periphery of valve oiling section 98.

Figure 13:
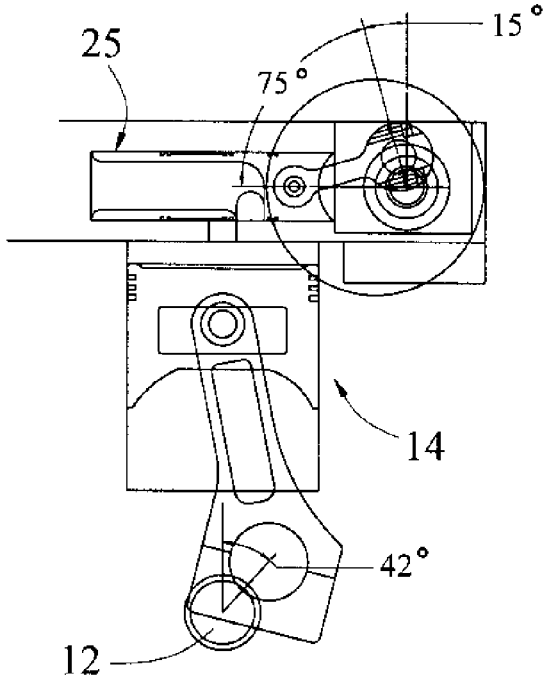
FIGS. 13-15 are diagrammatic views of progressive intake sliding valve movements during the intake stroke as the power crankshaft rotates.
Figure 14:
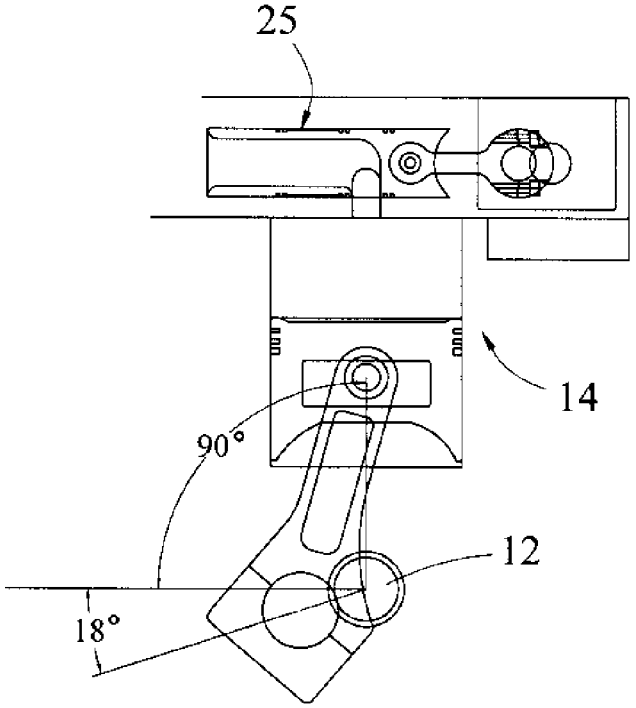

Operation:

In FIG. 13 intake valve 25 has started to open at the beginning of the intake stroke. In FIG. 14 the intake valve 25 is now open at approximately 108 degrees BTDC.

Figure 15:
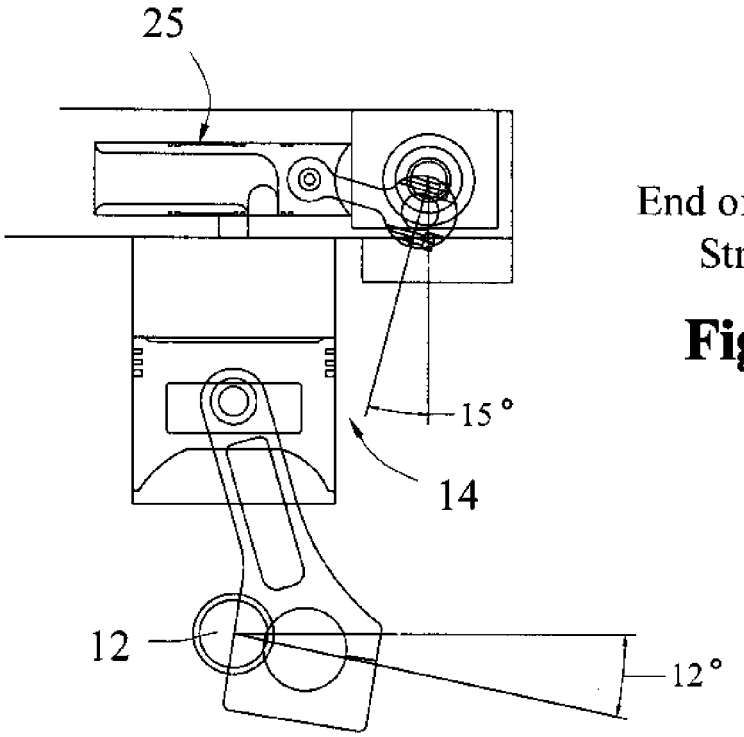
Figure 16:
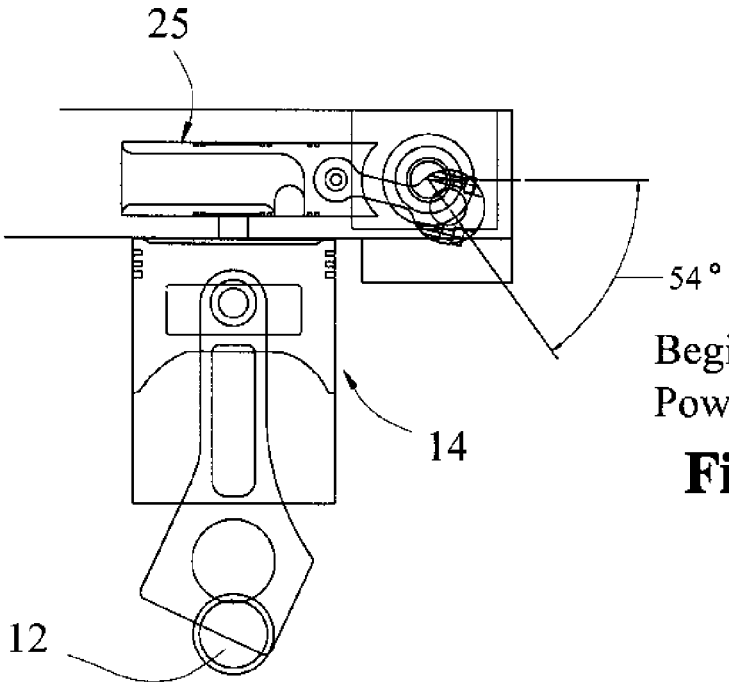
FIG. 16 is a diagrammatic view showing the intake valve position when the spark plug fires at the beginning of the power stroke.

FIG. 15 shows the intake valve 25 closing at the end of the intake stroke. Full closure of valve 25 is indicated in FIG. 16 at the beginning of the power stroke.

Figure 17:
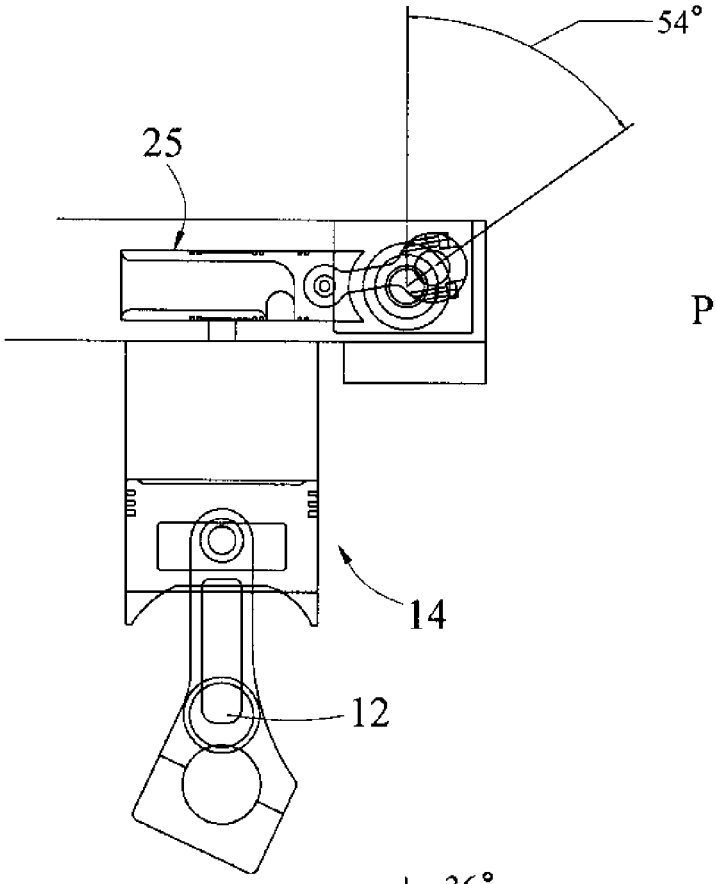
FIG. 17 is a diagrammatic view showing the intake valve position at the bottom of the power stroke.
Figure 18:
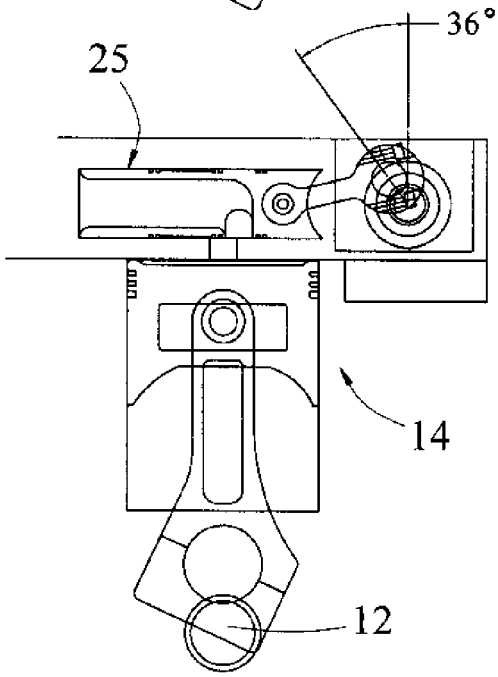
FIG. 18 is a diagrammatic view showing the intake valve position at the end of the exhaust stroke.

FIG. 17 shows the bottom of the power stroke, with the intake valve 25 fully closed. In FIG. 18 at the end of the exhaust stroke the intake valve 25 is seen starting to open.

Figure 19:
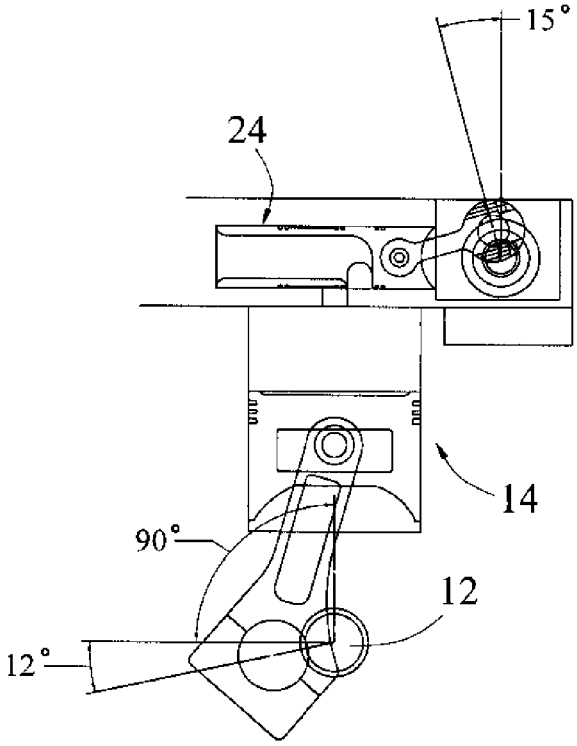
FIG. 19 is a diagrammatic view showing the exhaust valve position at the start of the exhaust stroke.
Figure 20:
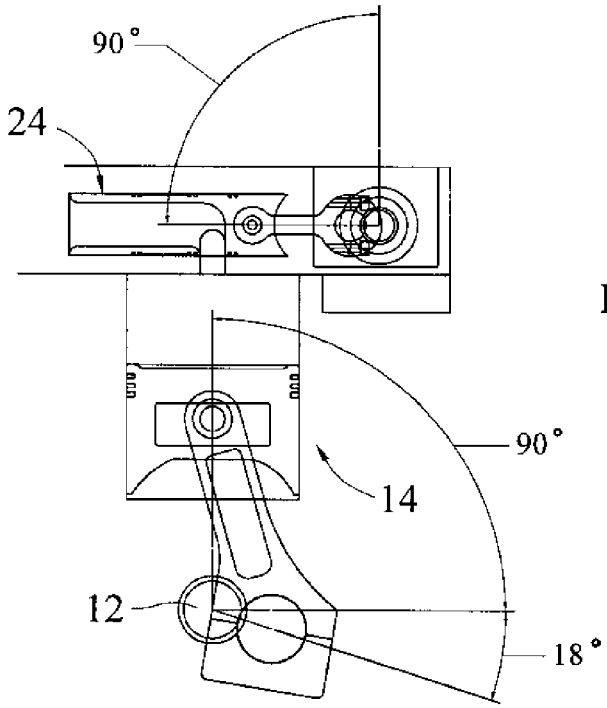
FIG. 20 is a diagrammatic view showing the fully open exhaust valve position at 251 degrees of engine crankshaft angle.

The exhaust valve 24 is seen in FIG. 19 at the start of the exhaust stroke. In FIG. 19, the plug and cylinder have fired, and at 108 degrees ATDC the exhaust valve 24 starts to open. In FIG. 20 the exhaust valve 24 is completely open, with 251 degrees crankshaft angle.

Figure 21:
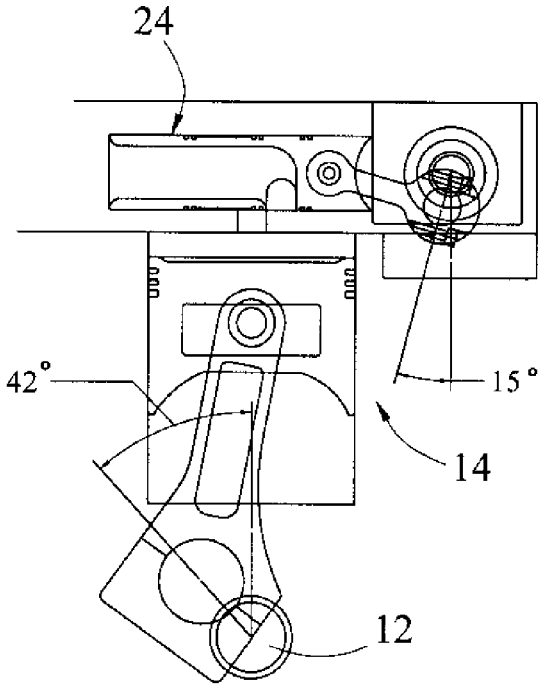
FIG. 21 is a diagrammatic view showing the closing exhaust valve at the beginning of the intake stroke at 222 degrees of crankshaft angle.
Figure 22:
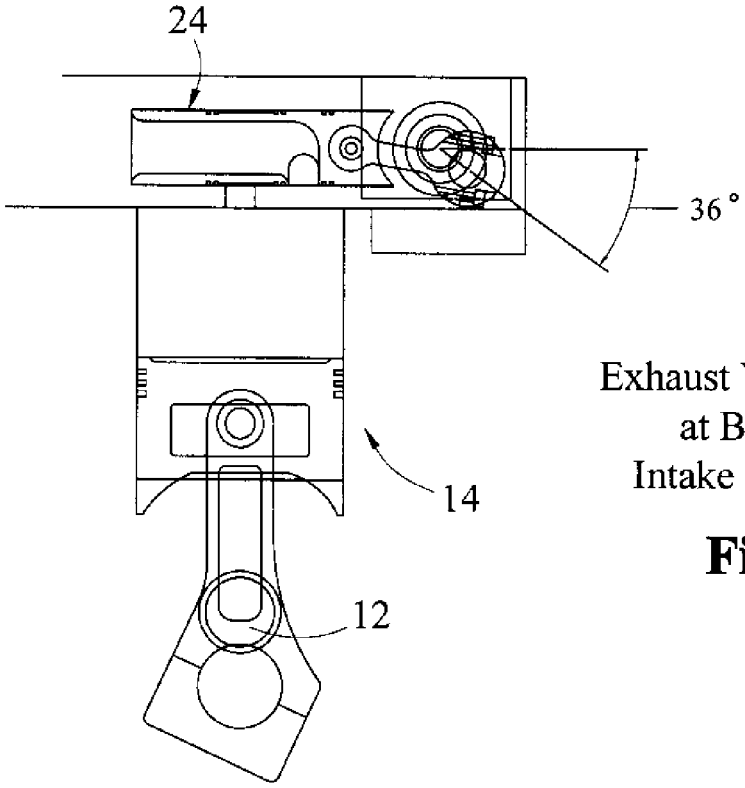
FIG. 22 is a diagrammatic view showing the fully closed exhaust valve at the bottom of the intake stroke at 180 degrees of crankshaft angle.

At the beginning of the intake stroke in FIG. 21 the exhaust valve 24 begins to close, at approximately 222 degrees. The bottom of the intake stroke is seen in FIG. 22, at which time the exhaust valve 24 is fully "closed," and the power stroke midsection 96 is positioned over the exhaust ports 68.

Figure 23:
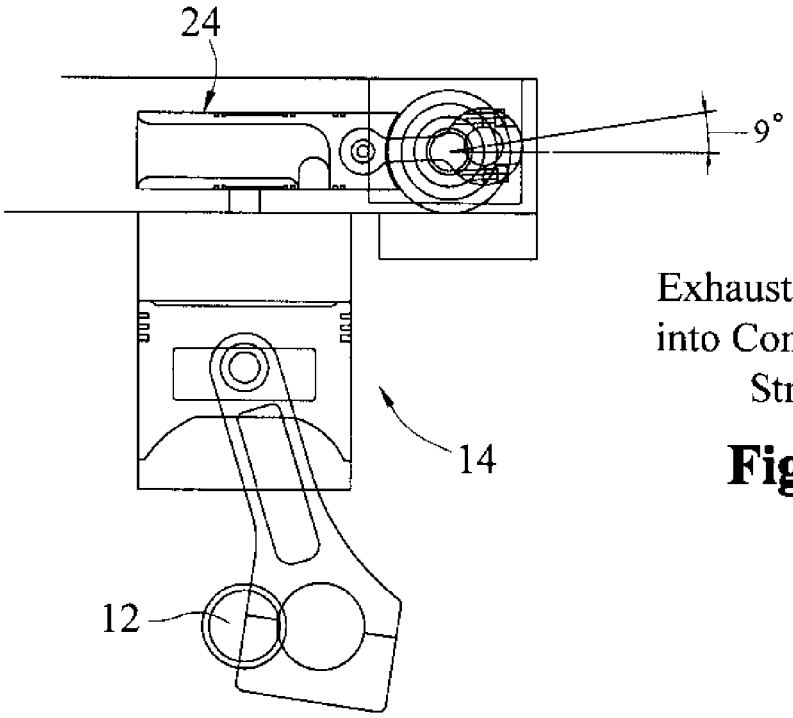
FIG. 23 is a diagrammatic view showing the closed exhaust valve 90 degrees into the compression stroke.
Figure 24:
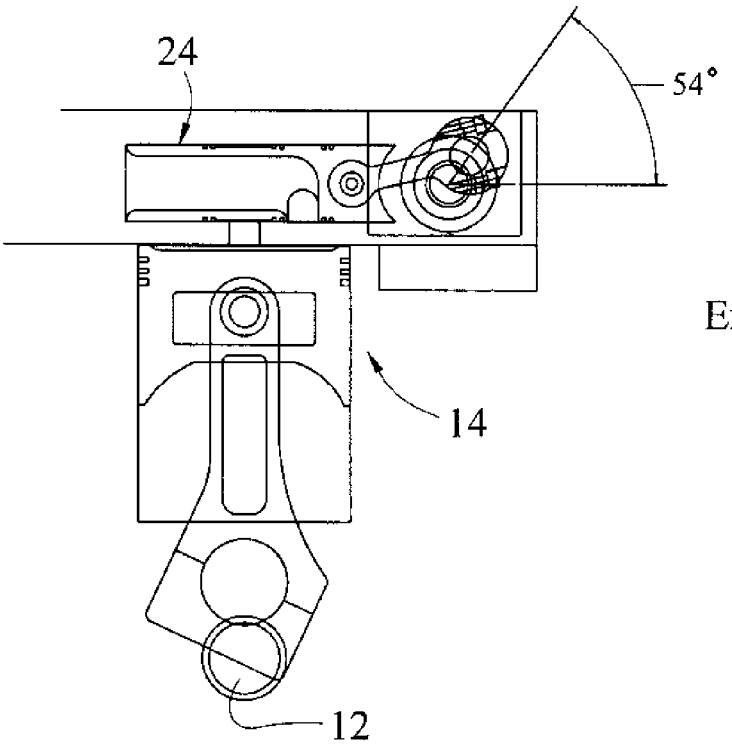
FIG. 24 is a diagrammatic view showing the closed exhaust valve at zero degrees TDC.

In FIG. 23 the exhaust valve 24 is completely open, 90 degrees into the compression stroke. In the positions of FIG. 24 the plug fires, and the exhaust valve 24 is completely closed at zero degrees TDC.

In FIGS. 25-28 the configuration and position of the crankshaft 32 is illustrated. The exhaust valve journal 40 and the intake journal 38 are seen in critical rotational positions.

Example:

| Dyno Test Chart-December 2008 | | |
|---|---|---|
| | FACTORY ENGINE | G1 ENGINE |
| LOW LOAD | | |
| Load % | 33% | 33% |
| RPM | 2900 | 2900 |
| Run Time | 1:30 minutes | 1:30 minutes |
| lb-ft Torque | 7.5 | 7.5 |
| Brake Horsepower | 4.1 | 4.1 |
| Fuel Usage - Milliliters | 12.07 | 10.86 |
| Nitrogen Oxide—NOX | 10.97 | 10.97 |
| Carbon Monoxide—CO | 0.95 | 1.07 |
| Hydrocarbons—HC | 21.9 | 2.39 |
| Carbon Dioxide—CO2 | 2.1 | 2 |
| Oxygen—O2 | 1.41 | 1.43 |
| G1 FUEL USAGE RESULTS PER UNIT OF BRAKE HORSEPOWER | | |
| Low Load Fuel Usage: 10% less than Factory Engine (12.07 − 10.86 = 1.21/12.07) | | |
| HIGH LOAD | | |
| Load % | 80% | 80% |
| RPM | 3550 | 3550 |
| Run Time | 1:30 minutes | 1:30 minutes |
| lb-ft Torque | 10 | 14 |
| Brake Horsepower | 6.7 | 9.4 |
| Fuel Usage - Milliliters | 13.19 | 8.65 |
| Nitrogen Oxide—NOX | 5.97 | 8.65 |
| Carbon Monoxide—CO | 0.58 | 0.44 |
| Hydrocarbons—HC | 11.04 | 1.07 |
| Carbon Dioxide—CO2 | 1.29 | 0.8 |
| Oxygen—O2 | 1.34 | 0.67 |
| G1 FUEL USAGE RESULTS PER UNIT OF BRAKE HORSEPOWER | | |
| High Load Fuel Usage: 34.4% less than Factory Engine 13.19 − 8.65 = 4.54/13.19) G1 HIGH LOAD EMISSION RESULTS PER UNIT OF BRAKE HORSEPOWER | | |
| NOX: 23.4% less than Factory Engine | HC: 90.3% less than Factory Engine | |
| CO: 24.1% less than Factory Engine | CO2: 37.9% less than Factory Engine | |

Two GX 390 Honda 13 hp engines were used for testing and comparisons (i.e., a "stock" engine versus one modified in accordance with the instant invention). Both engine specifications were as follows:

Four stroke valve single cylinder
3.5×2.5 bore & stroke
4.412 rod length
Forced air cooling systems
Gravity feed fuel systems
87 octane gasoline
23.7 cu/in displacement
Transistorized magnet ignition systems The muffler was removed on both engines to confine exhaust emissions for analysis purposes. The engine with the stock head is named the "Factory" engine on the above chart. The engine with our proprietary head is named the "G1" on the above chart.

All tests were conducted on the same day in a controlled and isolated environment. Fuel and emission measurements were made using the following equipment:

Land & Sea Water Brake Dyno, the Dyno-Max 2000 Model
Dyno-Max 2000 Data Analysis Software and Multimedia PC Demonstration, 9.38 SPI Version
UEI AGA 5000 Emissions Analyzer
ASTME rated ⅜ inch Bellwether 100 cc Tube The primary objective of house testing was to determine the fuel usage of the modified engine. We kept run time, load and rpm constant. To compare and measure the efficiency, input was divided by output. In our particular case, fuel usage was our input variable and our output variable was the pound-foot of torque produced. Fuel usage and all emissions results of both engines were calculated based on a unit of brake horsepower (torque×rpm/5252).

The low load fuel usage per unit of brake horsepower for the G1 engine was 10% less than the Factory engine. The high load fuel usage per unit of brake horsepower for the G1 engine above. It was determined that fuel consumption of the modified engine G1 was 34.4% less than the Factory engine. The high load emissions per unit of brake horsepower for the G1 engine resulted in 23.4% less nitrogen oxide (NOX), 24.1% less carbon monoxide (CO), 90.3% less hydrocarbons (HC) and 37.9% less carbon dioxide (CO2) compared to the Factory engine.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A slide valve for aspirating internal combustion engines, the slide valve comprising:

a tubular body adapted to be slidably disposed within a tubular tunnel or sleeve, said body comprising at least one aspiration port and an elongated, internal tubular passageway in fluid flow communication with said aspiration port for intaking or exhausting gases;

an open connecting rod section with an interior enabling mechanical connection to a rod for reciprocating the slide valve;

a closed interior wall that separates the connecting rod section from the internal tubular passageway;

a port section proximate said closed wall in which said at least one aspiration port is defined, wherein an arcuate cutout defined in said port section functions as said aspiration port, the cutout contacting said closed wall and the cutout comprising at least one radiused arch;

a tubular power stroke midsection adjacent the port section;

a tubular oiling section adjacent the power stroke midsection;

a terminal open section adjacent said oiling section that is in fluid flow communication with said tubular passageway;

said elongated, internal tubular passageway extending coaxially longitudinally between said closed wall and a spaced-apart, open valve end, the open valve end comprising radiused lips;

at least one concentric ring groove externally separating the valve rod section from the port section;

at least one concentric ring groove externally separating the valve port section from the adjacent valve power stroke midsection;

at least one concentric ring groove externally separating the valve midsection from the adjacent oiling section;

at least one concentric ring groove externally separating the valve oiling section from the valve open section; and, at least one sealing ring seated in said ring grooves.

2. The valve as defined in claim 1 wherein said connecting rod section interior is of a size substantially less than the diameter of said tubular passageway.

3. The valve as defined in claim 1 wherein each arcuate cutout radially extends between 30-40 percent around the radial periphery of the valve.

4. The valve as defined in claim 3 wherein the sealing rings are stepped for enhanced compression and comprise:

abutting ring ends with a notched region and a bordering tabbed region;

the tabbed regions variably spaced apart from said notched regions;

end gaps between the notched and tabbed regions compensating for thermal expansion and contraction; and, wherein tabbed regions of abutting ring ends abut one another and laterally seal the ring ends.

5. A slide valve for aspirating internal combustion engines, the slide valve comprising:

a tubular body adapted to be slidably disposed within a tubular tunnel or sleeve, said body comprising at least one aspiration port and an elongated, internal tubular passageway in fluid flow communication with said aspiration port for intaking or exhausting gases;

an open connecting rod section with an interior enabling mechanical connection to a rod for reciprocating the slide valve;

a closed interior wall that separates the connecting rod section from the internal tubular passageway;

a port section proximate said closed wall in which said at least one aspiration port is defined, wherein an arcuate cutout defined in said port section functions as said aspiration port, the cutout contacting said closed wall and the cutout comprising at least one radiused arch;

a power stroke midsection adjacent the port section;

an oiling section adjacent the midsection;

an open section adjacent said oiling section that is in fluid flow communication with said tubular passageway;

said elongated, internal tubular passageway extending coaxially longitudinally between said closed wall and a spaced-apart open valve end at said open section, the open 31 valve end comprising radiused lips;

the oiling section having a diameter reduced from that of the diameters of the port 2 section or open section to distribute oil about the circumference of the valve;

at least one concentric ring groove externally separating the valve rod section from the port section;

at least one concentric ring groove externally separating the valve port section from the adjacent valve power stroke midsection;

at least one concentric ring groove externally separating the valve midsection from the valve oiling section;

at least one concentric ring groove externally separating the valve oiling section from the valve open section; and, at least one sealing ring seated in each of said ring grooves.

6. The valve as defined in claim 5 wherein said connecting rod section interior is of a size substantially less than the diameter of said tubular passageway.

7. The valve as defined in claim 6 wherein each arcuate cutout radially extends between 30-40 percent around the radial periphery of the valve.

8. The valve as defined in claim 7 wherein the sealing rings are stepped for enhanced compression and comprise:

abutting ring ends with a notched region and a bordering tabbed region;

the tabbed regions variably spaced apart from said notched regions;

end gaps between the notched and tabbed regions compensating for thermal expansion and contraction; and, wherein tabbed regions of abutting ring ends abut one another and laterally seal the ring ends.

* * * * *